United States Patent [19]

Seto et al.

[11] Patent Number: 5,004,678

[45] Date of Patent: Apr. 2, 1991

[54] SILVER HALIDE COLOR PHOTOGRAPHIC MATERIAL

[75] Inventors: Nobuo Seto; Masakazu Morigaki, both of Kanagawa, Japan

[73] Assignee: Fuji Photo Film Co., Ltd., Kanagawa, Japan

[21] Appl. No.: 375,712

[22] Filed: Jul. 5, 1989

[30] Foreign Application Priority Data

Jul. 8, 1988 [JP] Japan ..... 63-170544

[51] Int. Cl.[5] ..... G03C 7/38

[52] U.S. Cl. ..... 430/548; 430/551; 430/558; 430/931

[58] Field of Search ..... 430/551, 558, 512, 931, 430/548

[56] References Cited

U.S. PATENT DOCUMENTS

| | | | |
|---|---|---|---|
| 4,254,216 | 3/1981 | Uchida et al. | 430/551 |
| 4,588,679 | 5/1986 | Furutachi | 430/551 |
| 4,675,275 | 6/1987 | Nishijima et al. | 430/551 |
| 4,735,893 | 4/1988 | Morigaki et al. | 430/551 |
| 4,865,963 | 9/1989 | Furutachi et al. | 430/551 |
| 4,868,100 | 9/1989 | Nishijima et al. | 430/558 |

*Primary Examiner*—Richard L. Schilling

*Attorney, Agent, or Firm*—Birch, Stewart, Kolasch & Birch

[57] ABSTRACT

A silver halide color photographic material comprising a support having thereon at least one silver halide emulsion layer, the silver halide color photographic material containing at least one pyrazoloazole type coupler represented by general formula (I) described below and at least one compound represented by general formula (II) described below.

Formula (I):

(I)

wherein $R_1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond; when the Zb—Zc bond is carbon-carbon double bond, the Zb-Zc bond may be a part of a condensed aromatic ring; $R_1$ or X may also form a polymer including a dimer or more; and when Za, Zb or Zc is a substituted methine group, the substituted methine group may form a polymer including a dimer or more;

Formula (II):

(II)

wherein $R_{10}$ and $R_{11}$, which may be the same or different, each represents an aliphatic group or an aromatic group; $R_{12}$ and $R_{13}$, which may be the same or different, each represents and aliphatic group, an aliphatic oxy group, an aromatic oxy group, and aliphatic thio group, an aromatic thio group, a nitrogen-containing heterocyclic group, an acylamino group, an aliphatic amino group or an aromatic amino group, or $R_{12}$ and $R_{13}$ may combine with each other to form a 5-membered or 6-membered hetero ring; and the aliphatic group or the aromatic group described above may be substituted.

The silver halide color photographic material provides magenta color images having improved fastness to light, and to humidity and heat.

20 Claims, No Drawings

SILVER HALIDE COLOR PHOTOGRAPHIC MATERIAL

FIELD OF THE INVENTION

The present invention relates to a silver halide color photographic material containing a combination of (i) a pyrazoloazole type magenta coupler and (ii) a specific dye stabilizer particularly effective to improve the light fastness of a dye image formed from the coupler.

BACKGROUND OF THE INVENTION

Magenta color image forming couplers which are widely used in practice and which have been intensively studied are the 5-pyrazolone type couplers It is known that dyes formed from 5-pyrazolone type couplers have excellent fastness to heat and light, but they have an undesirable absorption of the yellow component in the region around 430 nm, which causes color turbidity.

In order to decrease the yellow component absorption, a pyrazolobenzimidazole nucleus as described in British Patent 1,047,612, an indazolone nucleus as described in U.S. Pat. No. 3,770,447 and a pyrazolotriazole nucleus as described in U.S. Pat. No. 3,725,067 have been proposed as a magenta color image forming coupler skeleton.

The inventors have developed pyrazoloazole type magenta couplers including, for example, imidazo[1,2-b]pyrazoles, pyrazolo[1,5-b][1,2,4]triazoles, pyrazolo1,5-d]tetrazoles, pyrazolo[1,5-d]benzimidazoles and pyrazolopyrazoles. These pyrazoloazole type magenta couplers have good color-forming properties and form magenta dyes having little undesirable yellow absorption.

However, azomethine dyes formed from these pyrazoloazole type magenta couplers have relatively low fastness to light and humidity and heat. Moreover, when these azomethine dyes are exposed to light for a long period of time or preserved under high temperature and high humidity, color fading or discoloration of the dye images occurs, resulting in degradation of the image quality. Such color fading of the image is a fatal defect for recording materials. In order to overcome this problem, it has been proposed to selectively employ couplers less susceptible to color fading or to employ color fading preventing agents which can prevent color fading due to light.

In particular, the image degradation preventing effect of color fading preventing agents is large. It is already known that compounds obtained by etherification of a phenolic hydroxy group exhibit an excellent effect on preventing the color fading of dyes formed from pyrazoloazole type magenta couplers. For example, there are known diether type compounds obtained by dietherification of hydroquinones as described in U.S. Pat. No. 4,588,679, JP-A-59-125732, JP-A-60-262159, JP-A-282845, JP-A-61-292144 and JP-A-61-275842 (the term "JP-A" as used herein means an "unexamined published Japanese patent application"), methylenedioxybenzenes as described in JP-A-61-269154, ethylenedioxybenzenes as described in JP-A-63-13041, spiroindanes as described in U.S. Pat. No. 4,360,589, JP-A-61-282840 and JP-A-62244046, and spirochromans as described in JP-A-62-4045.

These compounds are excellent as color fading or discoloration preventing agents for dye images. However, they are still undesirable because the requirement of the fastness of the dye images has greatly increased with time.

The inventors have investigated in detail compounds obtained by the etherification of phenols and hydroquinones as described in the above patents in order to achieve sufficient fastness of a magenta color image formed from pyrazoloazole type magenta couplers. As a result, it has been surprisingly found that hydroquinone diether compounds having substituents on both the 2-position and 3-position thereof exhibit an extraordinarily large improving effect on fastness which can not be attained by other known hydroquinone diether type compounds.

SUMMARY OF THE INVENTION

An object of the present invention is to provide a silver halide color photographic material containing a pyrazoloazole type coupler represented by general formula (I), hereinafter described, which provides a color image having improved fastness to light, and humidity and heat.

Other objects of the present invention will become apparent from the following detailed description and examples.

These objects of the present invention can be accomplished by a silver halide color photographic material comprising a support having thereon at least one silver halide emulsion layer, the silver halide color photographic material containing at least one pyrazoloazole type coupler represented by general formula (I) described below and at least one compound represented by general formula (II) described below.

Formula (I):

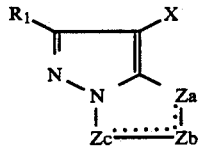

(I)

wherein $R_1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N- or -NH-, one of the Za—Zb bond and the Zb—Zc bond being a double bond and the other being a single bond; when the Zb—Zc bond is a carbon-carbon double bond, the Zb—Zc bond may be part of a condensed aromatic ring; $R_1$ or X may also form a polymer including a dimer or more; and when Za, Zb or Zc is a substituted methine group, the substituted methine group may form a polymer including a dimer or more;

Formula (II):

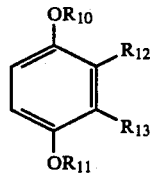

(II)

wherein $R_{10}$ and $R_{11}$, which may be the same or diff each represents an aliphatic group or an aromatic group; $R_{12}$ and $R_{13}$, which may be the same or different, each represents an aliphatic group, an aliphatic oxy group, an aromatic oxy group, an aliphatic thio group, an aromatic thio group, a nitrogen-containing heterocyclic group, an acylamino group, an aliphatic amino group or an aromatic amino group, or $R_{12}$ and $R_{13}$ may combine with each other to form a 5-membered or a 6-membered hetero ring; and the aliphatic group or the aromatic group described above may be substituted.

DETAILED DESCRIPTION OF THE INVENTION

The pyrazoloazole type coupler represented by general formula (I) above which can be employed in the present invention is described in detail hereinbelow.

The term "polymer" as used in the definition for general formula (I) means a compound containing at least two groups represented by general formula (I) in its molecule, which includes a bis coupler and a polymer coupler. The term "polymer coupler" as herein used includes a homopolymer composed of only a monomer having a moiety represented by general formula (I), and preferably having a vinyl group (the monomer having a vinyl group will hereinafter be referred to as a vinyl monomer), and a copolymer composed of a vinyl monomer described above and a non-color forming ethylenic monomer which does not undergo coupling with the oxidation product of an aromatic primary amine developing agent.

The compounds represented by general formula (I) are nitrogen-containing heterocyclic 5-membered ring-condensed-5-membered ring type couplers. Their color forming nuclei show aromaticity isoelectronic to naphthalene and have chemical structures inclusively called azapentalene.

The substituent represented by $R_1$ in general formula (I) is represented by the same groups as defined for $R_2$ in general formula (II) described hereinafter.

Preferred compounds among the couplers represented by general formula (I) are 1H-imidazo[1,2-b]pyrazoles, 1H-pyrazolo[5,1-c][1,2,4]triazoles, 1H-pyrazolo[1,5-b]pyrazoles, 1H-pyrazolo[1,5-b][1,2,4]-triazoles, 1H-pyrazolo[1,5-d]tetrazoles and 1H-pyrazolo[1,5-a]benzimidazoles represented by general formulae (I-1), (I-2), (I-3), (I-4), (I-5) and (I-6) respectively. Of these compounds, the compounds represented by general formulae (I-1), (I-3) and (I-4) are preferred, and those represented by general formula (I-4) are particularly preferred. Formulae (I-1) through (I-6) are represented as follows:

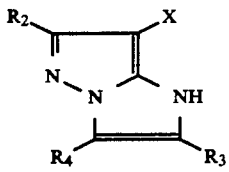

(I-1)

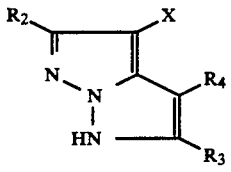

(I-2)

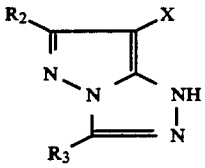

(I-3)

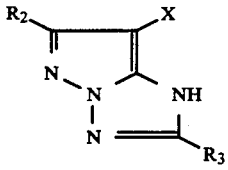

(I-4)

-continued

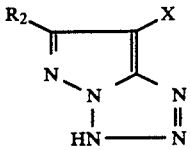

(I-5)

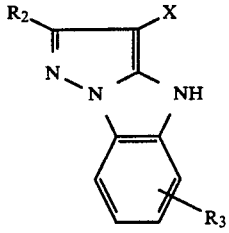

(I-6)

In general formula (I-1), (I-2), (I-3), (I-4), (I-5) or (I-6), $R_2$, $R_3$ and $R_4$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxy group or a group capable of being released upon coupling which is bonded to the carbon atom at the coupling position through an oxygen atom, a nitrogen atom or a sulfur atom.

Also, $R_2$, $R_3$, $R_4$ or X may be a divalent group to form a bis coupler. Further, the coupler represented by general formula (I-1), (I-2), (I-3), (I-4), (I-5) or (I-6) may be in the form of a polymer coupler in which general formula constitutes a partial structure of a vinyl monomer and $R_2$, $R_3$ or $R_4$ represents a chemical bond or a linking group, through which the partial structure of the formula (I-1), (I-2), (I-3), (I-4), (I-5) or (I6) and the vinyl group are connected together.

With respect to details of $R_2$, $R_3$, $R_4$ (including the case of forming a monomer or a bis compound), X and a non-color forming ethylenic comonomer used for forming a copolymer, the description in U.S. Pat. No. 4,540,654, 2nd column, line 41 to 8th column, line 27 is herein incorporated by reference.

Of these pyrazoloazole type couplers the following are preferably employed pyrazolotriazole couplers having a branched alkyl group (for example, a tert-butyl group, an isopropyl group, or those groups substituted with a ballast group) directly connected to the 2, 3 or 6 position of the pyrazolotriazole ring as described in JP-A-61-65245, pyrazoloazole couplers having a sulfonamido group in the molecule thereof as described in JP-A-61-65246, pyrazoloazole couplers having an alkoxyphenylsulfonamido ballast group as described in JP-A-61-147254, and pyrazolotriazole couplers having an alkoxy group or an aryloxy group (each may be further substituted) at the 6 position thereof as described in European Patent 226,849.

Further, the compounds represented by general formula (XI) as described in JP-A-61-275842, page 11 et al may be employed.

Formula (XI):

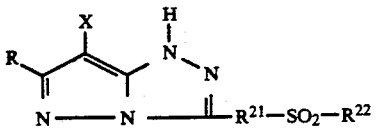

(XI)

wherein R represents a hydrogen atom or a substituent; $R^{21}$ represents an alkylene group; R22 represents an alkyl group, a cycloalkyl group or an aryl group; and X represents a hydrogen atom or a group capable of being released upon coupling.

Preferred examples of X in the pyrazoloazole type coupler represented by general formula (I) include a halogen atom, particularly a chlorine atom in the case wherein $R_2$ is connected to the pyrazoloazole ring through a carbon atom such as an alkyl group, and a halogen atom and a group capable of being released upon coupling which is bonded to the coupling position through an oxygen atom, a nitrogen atom or a sulfur atom in the case wherein $R_2$ is connected to the pyrazoloazole ring through a hetero atom such as an alkoxy group or an aryloxy group.

Specific examples of the pyrazoloazole type magenta couplers represented by general formulae (I-1), (I-2), (I-3), (I-4), (I-5) and (I-6) which can be used in the present invention and methods for the synthesis thereof are described in the following publications.

The compounds of general formula (I-1) are described, for example, in JP-A-59-162548; the compounds of general formula (I-2) are described, for example, in JP-A-60-143659; the compounds of general formula (I-3) are described, for example, in JP-B-47-27411 (the term "JP-B" as used herein means an "examined Japanese patent publication"); the compounds of general formula (I-4) are described, for example, in JP-A-59-171956 and JP-A-60-172982; the compounds of general formula (I-5) are described, for example, in JP-A-60-33552; and the compounds of general formula (I-6) are described, for example, in U.S. Pat. No. 3,061,432, respectively.

In addition, high color forming ballast groups are described, for example, in JP-A-58-42045, JP-A-59-177553, JP-A-59-177554 and JP-A-59-177557 and can be applied to any of the compounds represented by general formula (I-1), (I-2), (I-3), (I-4), (I-5) or (I-6) described above.

Specific examples of the pyrazoloazole type magenta couplers which can be employed in the present invention are set forth below, but the present invention should not be construed as being limited thereto.

(M-1)

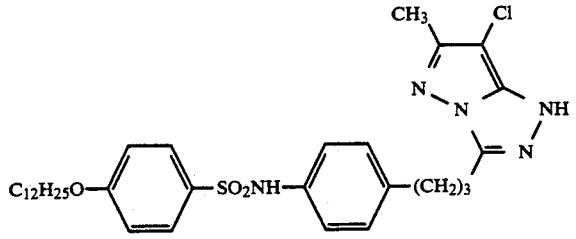

(M-2)

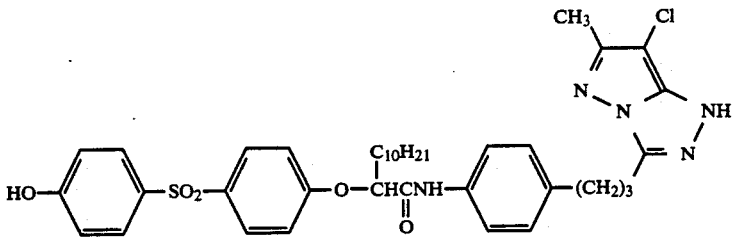

(M-3)

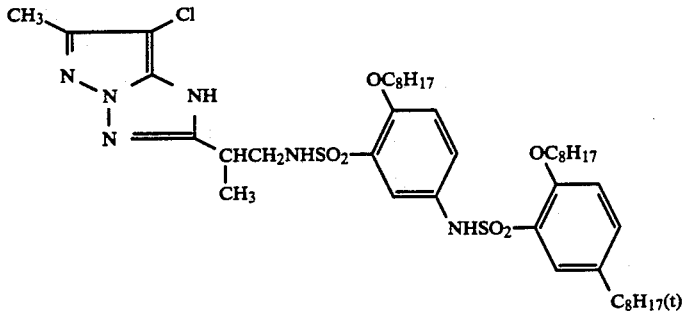

-continued
(M-4)
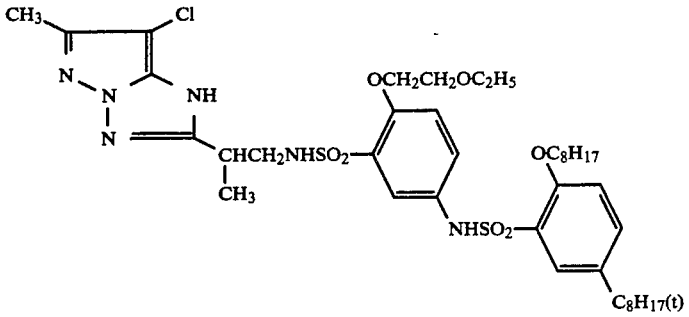
(M-5)
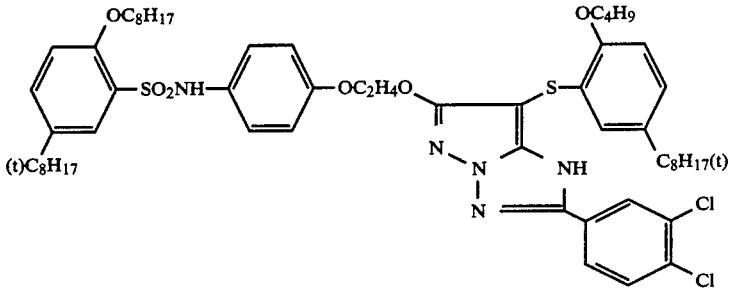
(M-6)
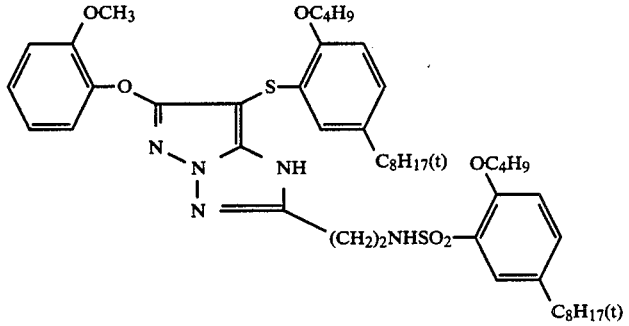
(M-7)
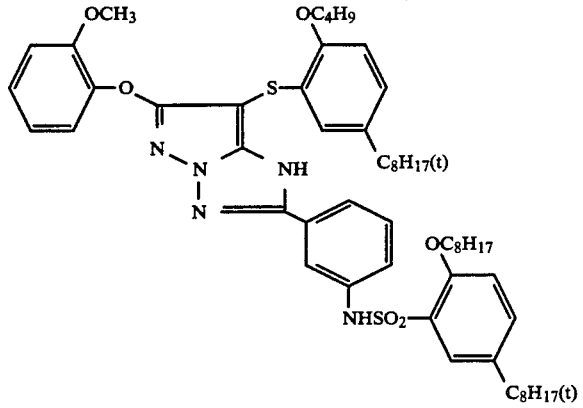

-continued
(M-8)
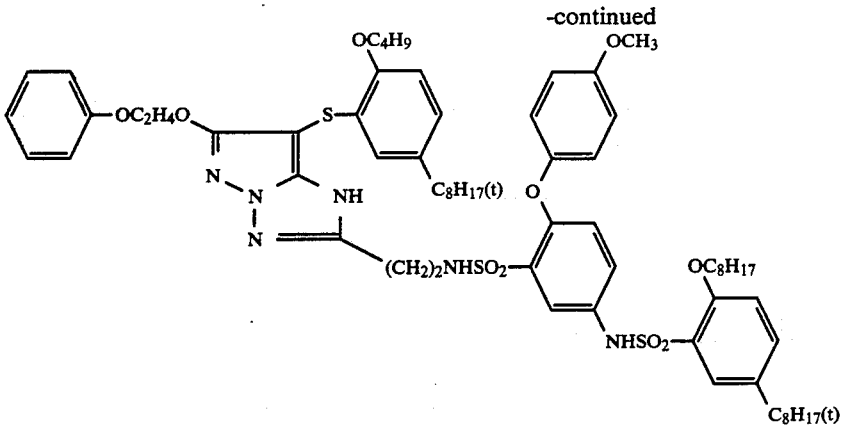
(M-9)
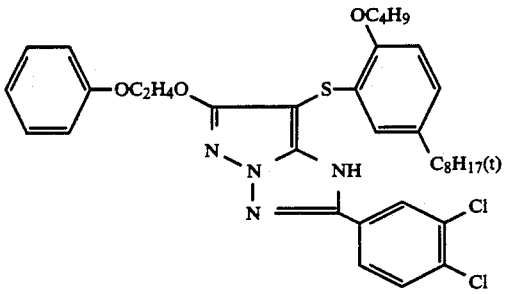
(M-10)
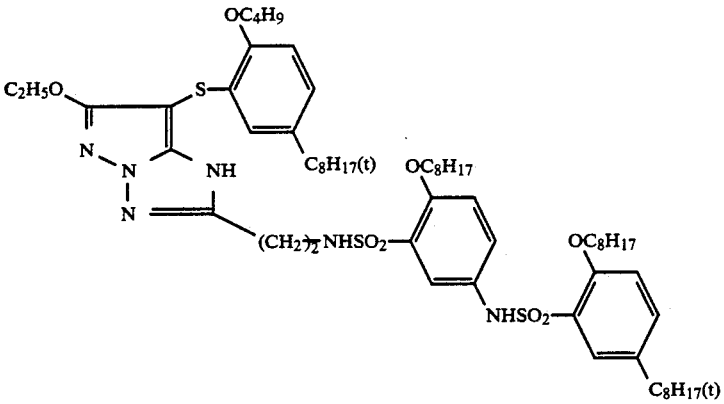
(M-11)
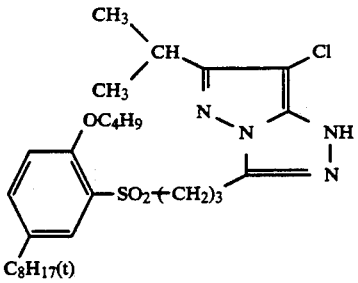
(M-12)
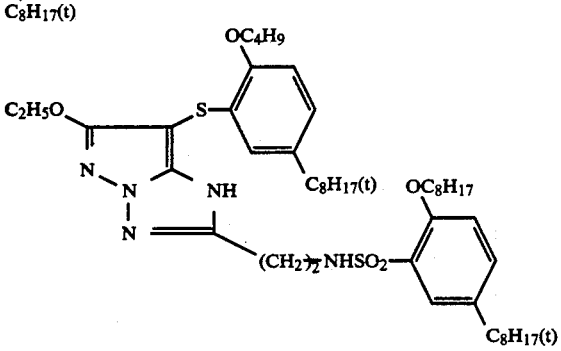

-continued
(M-13)
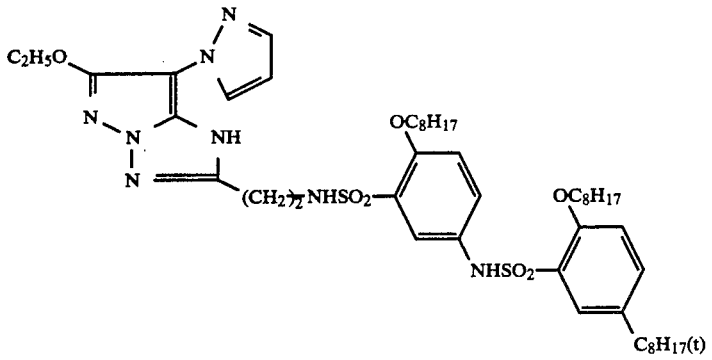
(M-14)
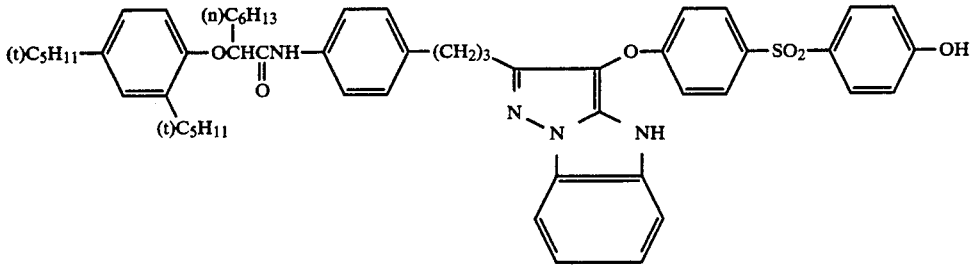
(M-15)
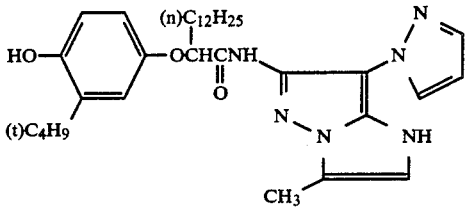
(M-16)
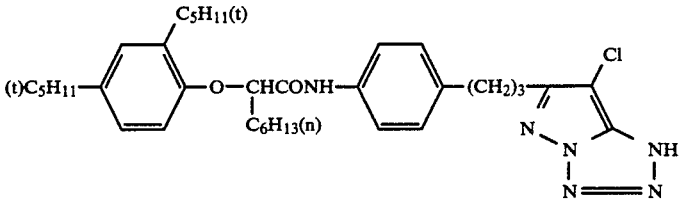
(M-17)
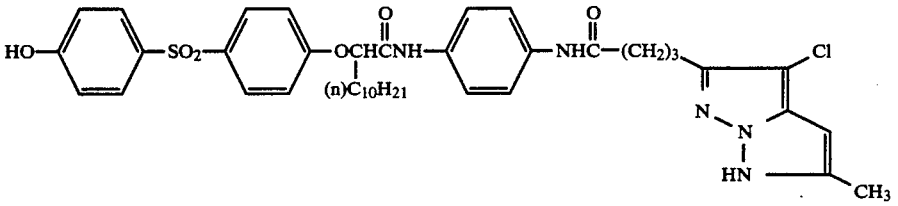
(M-18)
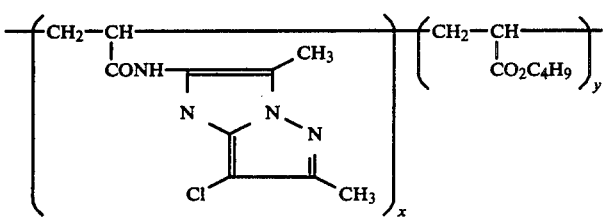
x:y = 50:50 (weight ratio)

-continued (M-19)

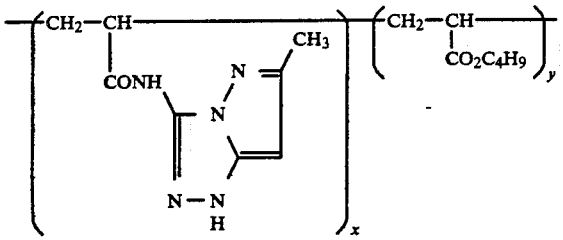

x:y = 50:50 (weight ratio)

(M-20)

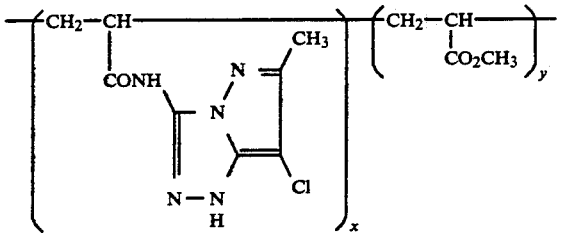

x:y = 40:60 (weight ratio)

(M-21)

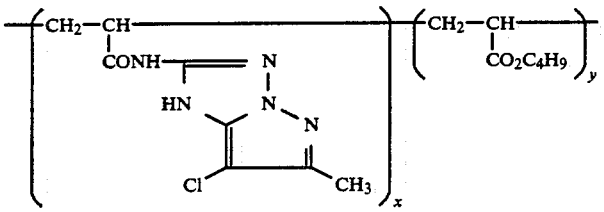

x:y = 50:50 (weight ratio)

(M-22)

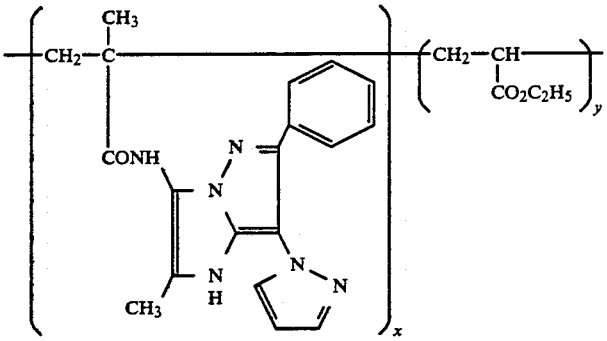

x:y = 55:45 (weight ratio)

Now, the compound represented by general formula (II) is described in detail below.

The term "aliphatic group" used herein means a straight chain, branched chain or cyclic, saturated or unsaturated aliphatic group and includes, for example, an alkyl group, an alkenyl group and an alkynyl group. The term "aromatic group" used herein means a monocyclic or polycyclic group. These groups may have one or more substituents. Preferred ranges of the number of carbon atoms included in these groups together with substituents, if any, are from 1 to 32 in the case of the aliphatic group and from 6 to 32 in the case of the aromatic group.

Specific examples of the aliphatic group include a methyl group, a butyl group, an octyl group, a tetradecyl group, a cyclohexyl group, and an allyl group. Specific examples of the aromatic group include a phenyl group, and a naphthyl group. Suitable examples of the substituents for these groups include an alkyl group, an aromatic group, a heterocyclic group, an alkoxy group (for example, methoxy, or 2-methoxyethoxy), an aryloxy group (for example, 2,4-di-tert-amylphenoxy, 2-chlorophenoxy, or 4-cyanophenoxy), an alkenyloxy group (for example, 2-propenyloxy), an acyl group (for example, acetyl, or benzoyl), an ester group (for example, butoxycarbonyl, phenoxycarbonyl, acetoxy, benzoyloxy, butoxysulfonyl, or toluenesulfonyloxy), an amido group (for example, acetylamino, methanesulfonamido, or dipropylsulfamoylamino), a carbamoyl group (for example, dimethylcarbamoyl, or ethylcarbamoyl), a sulfamoyl group (for example, butylsulfamoyl group), an imido group (for example, succinimido, or hydantoinyl), a ureido group (for example, phenylureido, or dimethylureido), an aliphatic or an aromatic sulfonyl group (for example, methanesulfonyl, or phenylsulfonyl), an aliphatic or aromatic thio group (for example, ethylthio, or phenylthio), a hydroxy group, a cyano group, a carboxy group, a nitro group, a sulfo group, and a halogen atom.

Suitable examples of the group formed by bonding $R_{12}$ and $R_{13}$ to each other include a methylenedioxy group, an ethylenedioxy group.

Preferred compounds represented by general formula (II) are those wherein $R_{12}$ and $R_{13}$ each represents an aliphatic group or an aliphatic oxy group.

Specific examples of the compounds represented by general formula (II) which can be employed in the present invention are set forth below, but the present invention should not be construed as being limited thereto.

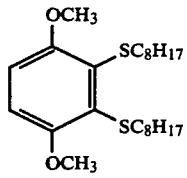

(A-1)

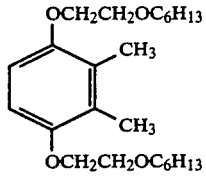

(A-2)

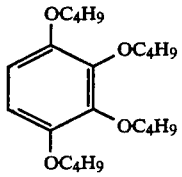

(A-3)

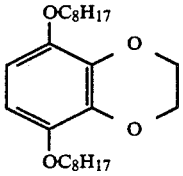

(A-4)

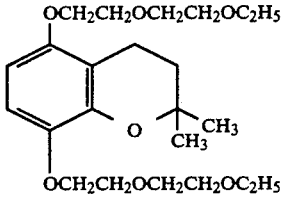

(A-5)

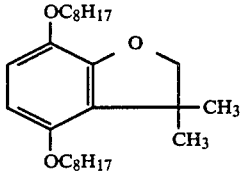

(A-6)

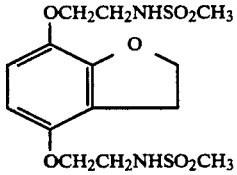

(A-7)

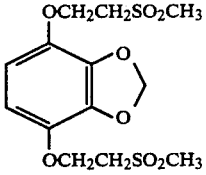

(A-8)

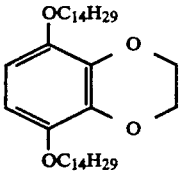

(A-9)

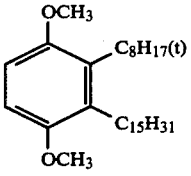

(A-10)

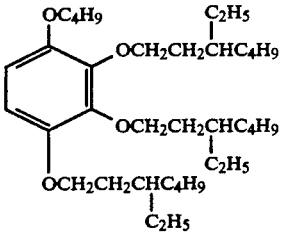

(A-11)

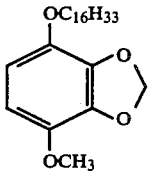

(A-12)

-continued

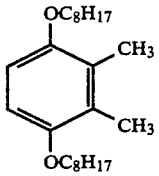

(A-13)

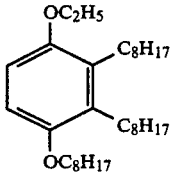

(A-14)

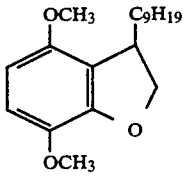

(A-15)

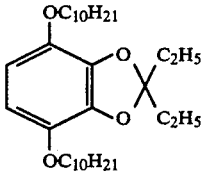

(A-16)

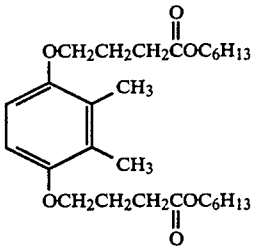

(A-17)

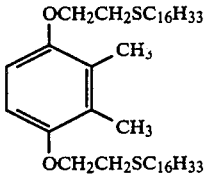

(A-18)

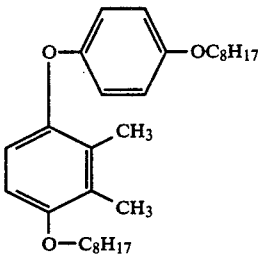

(A-19)

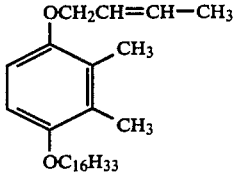

(A-20)

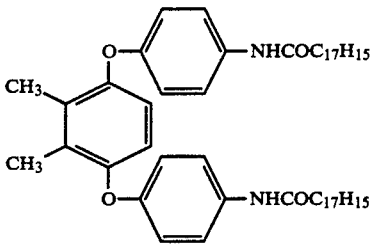

(A-21)

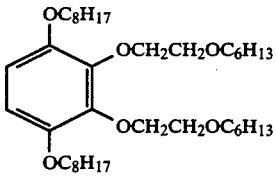

(A-22)

-continued

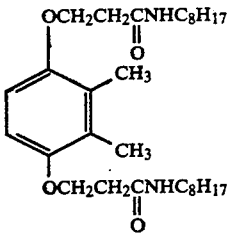

(A-23)

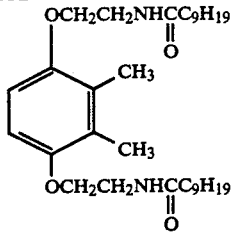

(A-24)

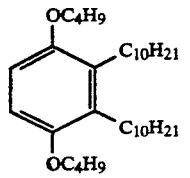

(A-25)

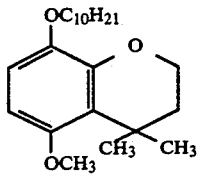

(A-26)

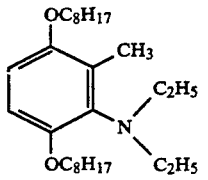

(A-27)

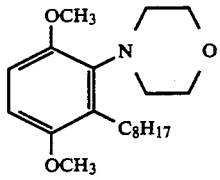

(A-28)

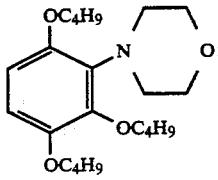

(A-29)

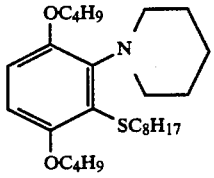

(A-30)

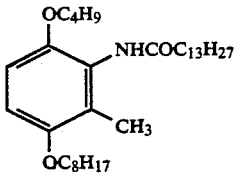

(A-31)

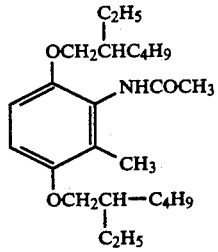

(A-32)

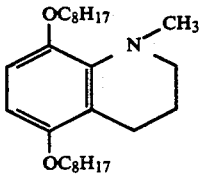

(A-33)

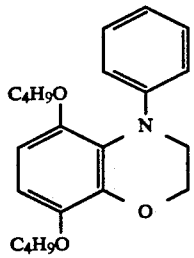

(A-34)

The compounds represented by general formula (II) can be synthesized according to the methods as described, for example, in *Shin-jikken Kaqaku Koza*, Vol. 14, page 574 and 550 (1977), *Tetrahedron*, Vol. 30, page 2887 (1974), JP-B-59-21846, JP-B-59-21014, and *Synthesis*, page 569 (1986).

It is particularly preferred to add the compound represented by general formula (II) to an emulsion layer containing the pyrazoloazole type magenta coupler represented by general formula (I).

In the practice of the present invention, additional known color fading preventing agents can also be employed.

Examples of known color fading preventing agents which may be used include hydroquinones, phenols, chromanols, coumarans, hindered amines, and complexes. Specific examples thereof are described, for example, in JP-A-59-83162, JP-A-58-24141, JP-A-52-152225, U.S. Pat. Nos. 3,698, 909 and 4,268,593, British Patents 2,069,162 (A) and 2,027,731.

Further, compounds represented by general formulae (A) to (H), (J) and (K) as described in JP-A-61-275842, pages 32 to 67 may be additionally employed.

The amount of the compound represented by general formula (II) to be used may vary depending on the kind of coupler used in combination. However, it is suitable to use in a range from 0.5 to 300% by weight, preferably from 2 to 250% by weight (corresponding to a range from 1 to 600 mol%, preferably from 4 to 500 mol %) based on the coupler represented by general formula (I). When the amount of the compound used is smaller than the above described range, the effect of preventing color fading becomes low. On the other hand, when the amount of the compound used is excessively large, a decrease in color density formed may occur due to a disturbance of development processing.

The magenta coupler according to the present invention is usually incorporated into a layer in an amount from $2\times10^{-3}$ to $5\times10^{-1}$ mol, preferably from $1\times10^{-2}$ to $5\times10^{-1}$ mol, per mol of silver.

In order to fulfill characteristics required for the photographic light-sensitive material, two or more kinds of couplers and color image stabilizers according to the present invention described above can be incorporated into the same layer, or the same compound may be incorporated into two or more different layers.

The magenta coupler represented by general formula (I) and the compound represented by general formula (II) can be introduced into the photographic light-sensitive material according to various known dispersing methods. Typical examples of the dispersing methods include a solid dispersing method, an alkali dispersing method, preferably a polymer dispersing method and an oil-droplet in water type dispersing method.

Representative polymer dispersing methods include a method of dispersing a hydrophobic compound using an organic solvent soluble and water insoluble polymer in the presence of or in the absence of an organic solvent having a high boiling point, and a method of loading a hydrophobic compound in a loadable latex. Among the above-described organic solvent soluble and water insoluble polymers, those described in WO 88/0072, pages 12 to 30 are also effective as color image stabilizers.

By means of the oil-droplet in water type dispersing method a hydrophobic compound is dispersed in an organic solvent having a high boiling point of 175° C. or more, a so-called auxiliary solvent having a low boiling point, or a mixture thereof and, then, the solution is finely dispersed in an aqueous medium such as water or an aqueous gelatin solution in the presence of a surface active agent. Specific examples of the organic solvent having a high boiling point are described in, for example, U.S. Pat. No. 2,322,027. Preparation of a dispersion may be accompanied by phase inversion. Further, a dispersion can be utilized for coating after removing or reducing the auxiliary solvent therein by distillation, noodle washing, or ultrafiltration, if desired.

Specific examples of the organic solvent having a high boiling point include phthalic acid esters (for example, dibutyl phthalate, dicyclohexyl phthalate, di-2-ethylhexyl phthalate, and decyl phthalate), phosphoric or phosphonic acid esters (for example, triphenyl phosphate, tricresyl phosphate, 2-ethylhexyldiphenyl phosphate, tributyl phosphate, tricyclohexyl phosphate, tri-2-ethylhexyl phosphate, trinonyl phosphate, tridecyl phosphate, tributoxyethyl phosphate, trichloropropyl phosphate, and di-2-ethylhexylphenyl phosphonate), benzoic acid esters (for example, 2-ethylhexyl benzoate, dodecyl benzoate, and 2-ethylhexyl-p-hydroxybenzoate), amides (for example, diethyldodecanamide and N-tetradecylpyrrolidone), alcohols or phenols (for example, isostearyl alcohol and 2,4-di-tert-amylphenol), aliphatic carboxylic acid esters (for example, dioctyl sebacate, dioctyl azelate, glycerol tributyrate, isostearyl lactate, and trioctyl citrate), aniline derivatives (for example, N(N-dibutyl-2-butoxy-5-tertoctylaniline), and hydrocarbons (for example, paraffin, dodecylbenzene, and diisopropylnaphthalene). As the auxiliary solvent, organic solvents having a boiling point of about 30° C. or more, preferably from about 50° C. to about 160° C, can be used. Typical examples of such auxiliary solvents include ethyl acetate, butyl acetate, ethyl propionate, methyl ethyl ketone, cyclohexanone, 2-ethoxyethyl acetate, and dimethylformamide.

The process and effects of latex dispersing methods and the specific examples of latices for loading are described in U.S. Pat. No. 4,199,363 and West German Patent Application (OLS) Nos. 2,541,274 and 2,541,230.

In the photographic emulsion layer of the photographic light-sensitive material according to the present invention, the type of silver halide which may be used includes silver bromide, silver iodobromide, silver iodochlorobromide, silver chlorobromide or silver chloride.

Silver halide grains in the photographic emulsion may have a regular crystal structure, for example, a cubic, octahedral or tetradecahedral structure, an irregular crystal structure, for example, a spherical structure, a crystal defect, for example, a twin plane, or a composite structure thereof. Silver halide grains having a regular crystal structure, for example, a cubic or tetradecahedral structure are preferably used.

The grain size of the silver halide may be varied and may include fine grains of about 0.1 micron or less to large size grains of about 10 microns relative to the diameter of the projected area. Further, while a monodisperse emulsion having a narrow grain size distribution and a polydisperse emulsion having a broad grain size distribution may be used, a monodisperse emulsion is preferably employed.

The silver halide photographic emulsion used in the present invention can be prepared using known methods, for example, those as described in *Research Disclosure,* Vol. 176, No. 17643 (December, 1978), pages 22 to 23, "I. Emulsion Preparation and Types" and ibid., Vol. 187, No. 18716 (November 1979), page 648.

The photographic emulsion used in the present invention can be prepared in any suitable manner, for example, by the methods described in P. Glafkides, *Chemie et physique Photographique,* Paul Montel (1967), G. F. Duffin, *Photographic Emulsion Chemistry,* The Focal Press (1966), and V.L. Zelikman et al., *Making and Coating Photographic Emulsion,* The Focal Press (1964). In other words, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

One system of the double ]et process is preferably employed, that is, a so-called controlled double jet process in which the pAg in a liquid phase where the silver halide is formed is maintained at a predetermined level. This process can produce a silver halide emulsion in which the crystal form is regular and the grain size is nearly uniform.

Two or more kinds of silver halide emulsions which are prepared separately may be used as a mixture.

Silver halide emulsions composed of regular grains as described above can be obtained by controlling the pAg and the pH during the step of formation of the silver halide grains. The details thereof are described, for example, in *Photographic Science and Engineering,* Vol. 6, pages 159 to 165 (1962), *Journal of Photographic Science,* Vol. 12, pages 242 to 251 (1964), U.S. Pat. No. 3,655,394, and British Patent 1,413,748.

Representative monodisperse emulsions are those comprising silver halide grains having an average grain size of about 0.1 micron or more and at least about 95% by weight of the total silver halide grains having a size within the range of the average grain size ±40%. In the present invention, it is preferred to employ a monodisperse emulsion comprising silver halide grains having an average grain size of from about 0.25 microns to about 2 microns and at least 95% by weight, or by a number of particles of the total silver halide grains having a size within the range of the average grain size ±30%, particularly ±20%. Methods for the preparation of such monodisperse emulsions are described in U.S. Pat. Nos. 3,574,628 and 3,655,394, and British Patent 1,413,748. Further, monodisperse emulsions as described in JP-A-48-8600, JP-A-51-39027, JP-A-51-83097, JP-A-53-137133, JP-A-54-48521, JP-A-54-99419, JP-A-58-37635, and JP-A-58-49938 can be employed in the present invention.

In the case of mixing two or more monodisperse emulsions or mixing a monodisperse emulsion and a polydisperse emulsion, the monodispersity of the mixed emulsion is preferably in the range described above, although it is not necessary to be within the range.

Further, tabular silver halide grains having an aspect ratio of about 5 or more can be employed in the present invention. The tabular grains may be easily prepared by the method as described, for example, in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157. In the case of employing the tabular silver halide grains, many advantages are described in detail in U.S. Pat. No. 4,434,226 and in the other publications described above. For example, an increase in spectral sensitizing efficiency with a sensitizing dye, an improvement in graininess and an improvement in sharpness are described in these publications.

The crystal structure of the silver halide grains may be uniform, composed of different halide compositions between the interior and the surface portion, or may have a stratified structure. Examples of such emulsion grains are described, for example, in British Patent 1,027,146, U.S. Pat. Nos. 3,505,068 and 4,444,877, and JP-A-60-143331.

Further, silver halide emulsions in which silver halide grains having different compositions are connected upon epitaxial junctions or silver halide emulsions in which silver halide grains are connected with compounds other than silver halide such as silver thiocyanate, or lead oxide may also be employed. Examples of such emulsion grains are described, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

Particularly useful silver halide grains are silver chlorobromide grains having a localized phase of silver bromide isolated on the surface of the grains or in the stratified form in the grains. These silver halide grains are described in detail in Japanese Patent Application No. 62-319741 (corresponding to European Patent 0,273,430).

The photographic emulsion used in the present invention is usually conducted with physical ripening, chemical ripening and spectral sensitization. Various kinds of additives which can be employed in these steps are described in *Research Disclosure,* No. 17643 (December, 1978) and ibid., No. 18716 (November, 1979) and relevant items thereof are summarized in the table show below.

Further, other photographic additives which can be used in the present invention are also described in the above mentioned *Research Disclosure,* No. 17643 (December 1978) and ibid., No. 18716 (November, 1979) and relevant items thereof are also summarized in the table shown below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Supersensitizers | Pages 23 to 24 | Page 648, right column to page 649, right column |
| 4. Antifoggants and Stabilizers | Pages 24 to 25 | Page 649, right column |
| 5. Light-Absorbers, Filter Dyes and Ultraviolet Ray Absorbers | Pages 25 to 26 | Page 649, right column to page 650, left column |
| 6. Antistaining Agents | Page 25, right column | Page 650, left column to right column |
| 7. Hardeners | Page 26 | Page 651, left column |

-continued

| Kind of Additives | RD 17643 | RD 18716 |
|---|---|---|
| 8. Binders | Page 26 | Page 651, left column |
| 9. Plasticizers and Lubricants | Page 27 | Page 650, right column |
| 10. Coating Aids and Surfactants | Pages 26 to 27 | Page 650, right column |
| 11. Antistatic Agents | Page 27 | Page 650, right column |

In the present invention, various color couplers can be employed and specific examples thereof are described, for example, in the patents cited in *Research Disclosure,* No. 17643, "VII-C" to "VII-G" as mentioned above. As dye forming couplers, couplers capable of providing three primary colors (i.e., yellow, magenta and cyan) in the subtractive process upon color development are important. Specific examples of preferred diffusion-resistant, four-equivalent or two-equivalent couplers are described in the patents cited in *Research Disclosure,* No. 17643, "VII-C" and "VII-D" as mentioned above. In addition, couplers as described below are preferably employed in the present invention.

As typical yellow couplers used in the present invention, hydrophobic acylacetamide type couplers having a ballast group are exemplified. Among them, α-pivaloylacetanilide type couplers as described in U.S. Pat. Nos. 4,622,287 and 4,623,616 are characterized by excellent fastness, particularly light fastness, of dyes formed, and α-benzoylacetanilide type couplers, as described in U.S. Pat. Nos. 3,408,194 and 3,933,501 are characterized by providing high color density.

More specifically, suitable pivaloylacetanilide type yellow couplers include Compounds (Y-1) to (Y-39) as described in the above mentioned U.S. Pat. No. 4,622,287, column 37 to column 54. Of these compounds, Compounds (Y-1), (Y-4), (Y-6), (Y-7), (Y-15), (Y-21), (Y-22), (Y-23), (Y-26), (Y-.35), (Y-36), (Y-37), (Y-38) and (Y-39) are preferred.

Further, Compounds (Y-1) to (Y-33) as described in the above mentioned U.S. Pat. No. 4,623,616, column 19 to column 24 are suitable. Of these compounds, Compounds (Y-2), (Y-7), (Y-8), (Y-12), (Y-20), (Y-21), (Y-23) and (Y-29) are preferred.

Moreover, Compound (34) as described in U.S. Pat. No. 3,408,194, column 6; Compounds (16) and (19) as described in U.S. Pat. No. 3,933,501, column 8; Compound (9) as described in U.S. Pat. No. 4,046,575, column 7 to column 8; Compound (1) as described in U.S. Pat. No. 4,133,958, column 5 to column 6; Compound 1 as described in U.S. Pat. No. 4,401,752, column 5; and Compounds (a) to (g) described below are also preferred.

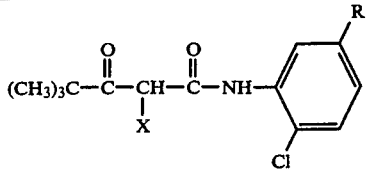

| Compound | R | X |
|---|---|---|
| a | $-COOCH(CH_3)COOC_{12}H_{25}$ | 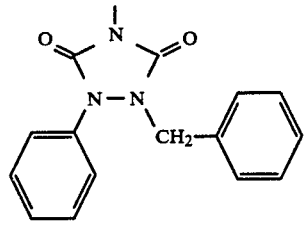 |
| b | $-COOCH(C_4H_9)COOC_{12}H_{25}$ | 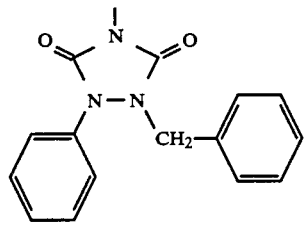 |
| c | 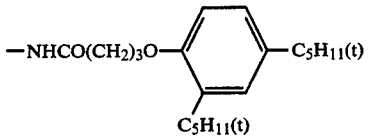 | 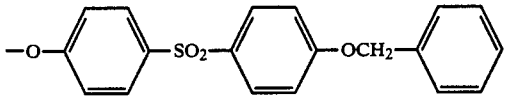 |
| d | 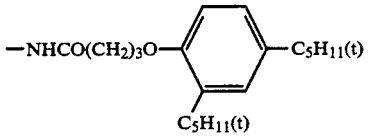 | 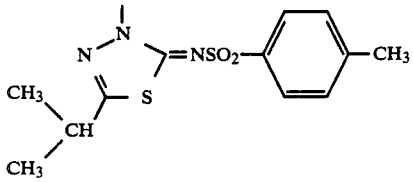 |
| e | 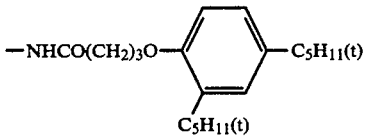 | 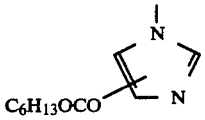 |
| f | $-NHSO_2C_{12}H_{25}$ | 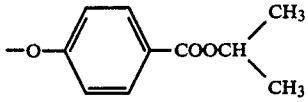 |
| g | $-NHSO_2C_{16}H_{33}$ | 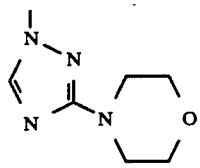 |

As magenta couplers which can be used together with the pyrazoloazole type couplers according to the present invention, 5-pyrazolone type couplers are exemplified. Of the 5-pyrazolone type couplers, those substituted with an arylamino group or an acylamino group at the 3-position thereof are preferred in view of hue and color density of the dyes formed. Typical examples thereof are described, for example, in U.S. Pat. Nos. 2,311,082, 2,343,703, 2,600,788, 2,908,573, 3,062,653, 3,152,896, and 3,936,015. Two-equivalent 5-pyrazolone type couplers containing nitrogen atom linked releasing groups as described in U.S. Pat. No. 4,310,619 and arylthio groups as described in U.S. Pat. No. 4,351,397, as releasing groups are particularly preferred. Further, 5-pyrazolone type couplers having a ballast group as described in European Patent 73,636 are advantageous because they provide high color density.

The most representative examples of cyan couplers which can be used in the present invention are phenol type cyan couplers and naphthol type cyan couplers.

Suitable examples of the phenol type cyan couplers include those having an acylamino group at the 2-position of the phenol nucleus and an alkyl group at the 5-position thereof (including polymer couplers) as described, for example, in U.S. Pat. Nos. 2,369,929, 4,518,687, 4,511,647 and 3,772,002. Representative specific examples thereof include the coupler as described in Example 2 of Canadian Patent 625,822, Compound (1) as described in U.S. Pat. No. 3,772,002, Compounds (I-4) and (I-5) as described in U.S. Pat. No. 4,564,590, Compounds (1), (2), (3) and (24) as described in JP-A-61-39045, and Compound (C-2) as described in JP-A-62-70846.

Suitable examples of the phenol type cyan couplers include 2,5-diacylamino-substituted phenol type couplers as described, for example, in U.S. Pat. Nos. 2,772,162, 2,895,826, 4,334,011 and 4,500,653, and JP-A59-164555. Representative specific examples thereof include Compound (V) as described in U.S. Pat. No. 2,895,826, Compound (17) as described in U.S. Pat. No. 4,557,999, Compounds (2) and (12) as described in U.S. Pat. No. 4,565,777, Compound (4) as described in U.S. Pat. No. 4,124,396 and Compound (I-19) as described in U.S. Pat. No. 4,613,564.

Other suitable examples of the phenol type cyan couplers include those in which a nitrogen-containing heterocyclic ring is condensed to the phenol nucleus as described, for example, in U.S. Pat. No. 4,327,173, 4,564,586 and 4,430,423, JP-A-61-390441 and Japanese Patent Application No. 61-100222 (corresponding to JP-A-62-257158). Representative specific examples thereof include Couplers (1) and (3) as described in U.S. Pat. No. 4,327,173, Compounds (3) and (16) as described in U.S. Pat. No. 4,564,586 and Compounds (1) and (3) as described in U.S. Pat. No. 4,430,423, as well as the compounds described below.

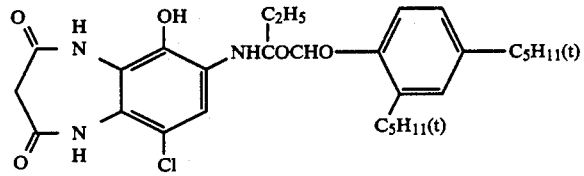

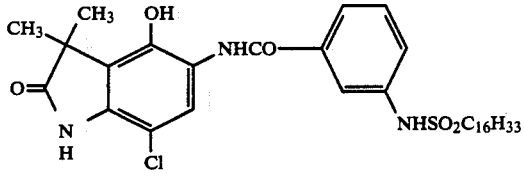

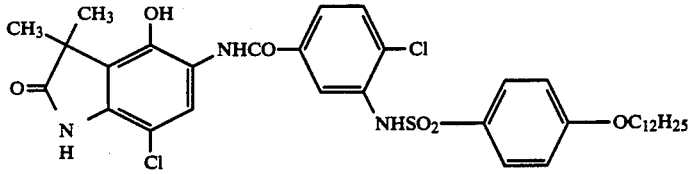

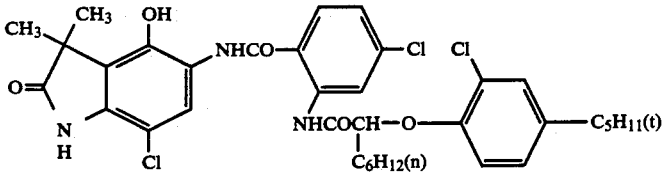

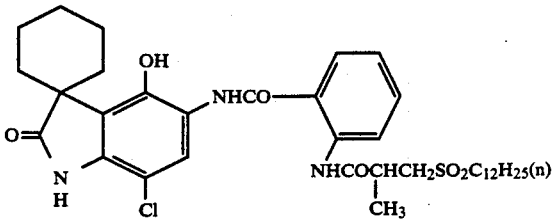

-continued

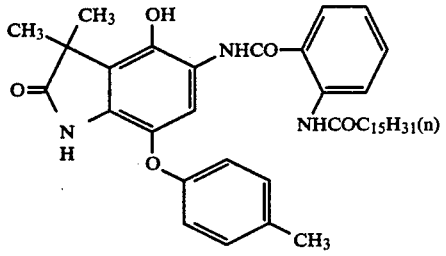

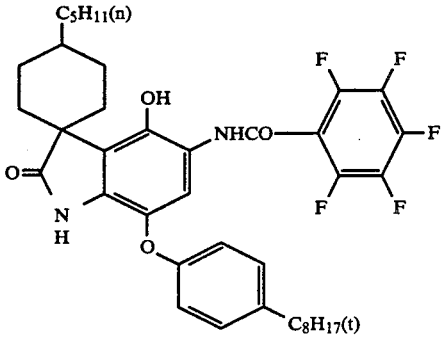

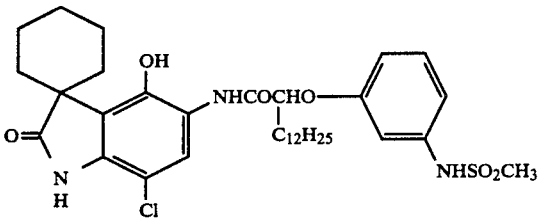

Furthermore, other suitable examples of the phenol type cyan couplers include ureido type couplers as described, for example, in U.S. Pat. Nos. 4,333,999, 4,451,559, 4,444,872, 4,427,767 and 4,579,813 and European Patent 067,689Bl. Representative specific examples thereof include Coupler (7) as described in U.S. Pat. No. 4,333,999, Coupler (1) as described in U.S. Pat. No. 4,451,559, Coupler (14) as described in U.S. Pat. No. 4,444,872, Coupler (3) as described in U.S. Pat. No. 4,427,767, Couplers (6) and (24) as described in U.S. Pat. No. 4,609,619, Couplers (1) and (11) as described in U.S. Pat. No. 4,579,813, Couplers (45) and (50) as described in European Patent 067,689Bl and Coupler (3) as described in JP-A-61-42658.

Suitable examples of the naphthol type cyan couplers include those having an N-alkyl-N-arylcarbamoyl group at the 2-position of the naphthol nucleus as described, for example, in U.S. Pat. No. 2,313,586, those having an alkylcarbamoyl group at the 2-position of the naphthol nucleus as described, for example, in U.S. Pat. Nos. 2,474,293 and 4,282,312, those having an arylcarbamoyl group at the 2-position of the naphthol nucleus as described, for example, in JP-B-50-14523, those having a carbonamido group or a sulfonamido group at the 5-position of the naphthol nucleus as described, for example, in JP-A-60-237448, JP-A-61-145557 and JP-A61-153640, those having an aryloxy releasing group as described, for example, in U.S. Pat. No. 3,476,563, those having a substituted alkoxy releasing group as described, for example, in U.S. Pat. No. 4,296,199, and those having a glycolic acid releasing group as described, for example, in JP-B-60-39217.

In addition, diphenylimidazoles as described in EP-A-249,453 may be employed as cyan couplers. Specific examples thereof are set forth below.

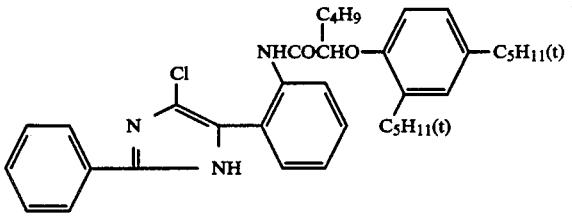

-continued

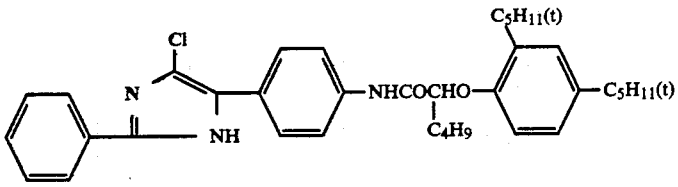

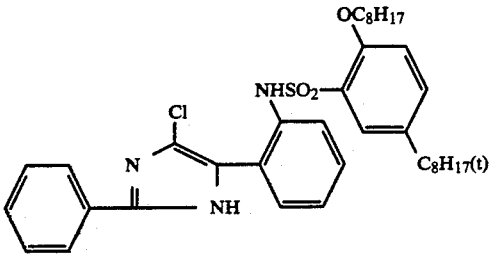

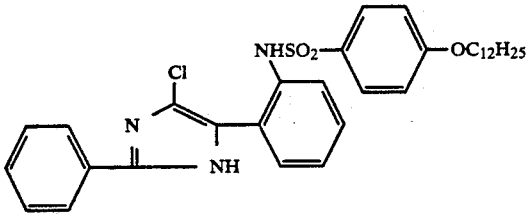

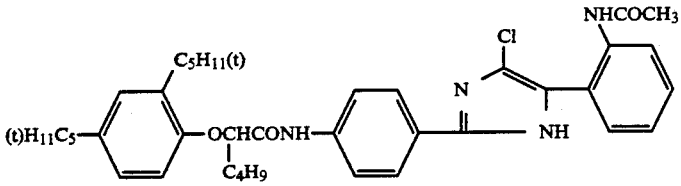

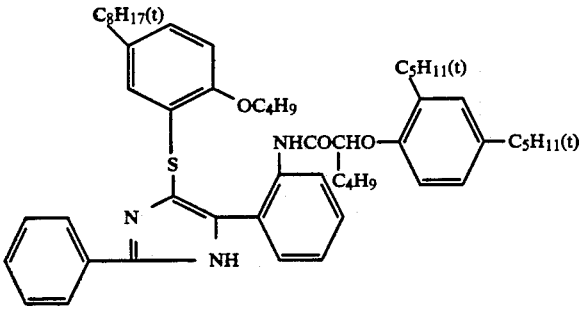

It is preferred to use colored couplers for masking together in color photographic light-sensitive materials for photographing in order to correct undesirable absorptions of the dyes formed. Typical examples of colored couplers include yellow-colored magenta couplers as described, for example, in U.S. Pat. No. 4,163,670 and JP-B-57-39413 and magenta-colored cyan couplers as described, for example, in U.S. Pat. Nos. 4,004,929 and 4,138,258 and British Patent 1,146,368. Other examples of useful colored couplers are described in *Research Disclosure,* No. 17643, "VII-G" as mentioned above.

Further, couplers capable of forming appropriately diffusible dyes can be used together in order to improve graininess. Specific examples of such types of magenta couplers are described, for example, in U.S. Pat. No. 4,366,237 and British Patent 2,125,570 and yellow, magenta and cyan couplers are described, for example, in European Patent 96,570 and West German Patent Application (OLS) No. 3,234,533.

Dye forming couplers and the above described specific couplers may form polymers including dimers or more. Typical examples of polymerized dye forming couplers are described, for example, in U.S. Pat. Nos. 3,451,820 and 4,080,211. Specific examples of polymerized magenta couplers are described, for example, in British Patent 2,102,173 and U.S. Pat. No. 4,367,282.

Couplers capable of releasing a photographically useful residue during the course of coupling can also be preferably employed in the present invention. Specific examples of useful DIR couplers capable of releasing a development inhibitor are described in the patents cited in *Research Disclosure,* No. 17643, "VII-F" described above.

Of the DIR couplers, those of the deactivation type in a developing solution as represented by JP-A-57-151944, those of the timing type as represented by U.S. Pat. No. 4,248,962 and JP-A-57-154234, and those of the reactive type as represented by JP-A-60-184248 are preferably employed in combination with the present invention. Further, DIR couplers of the deactivation type in a developing solution as described, for example, in JP-A-57-151944, JP-A-58-217932, JP-A-60-218644, JP-A60-225156 and JP-A-60-233650, and DIR couplers of the reactive type as described, for example, in JP-A-60-184248 are particularly preferred.

Suitable supports which can be used in the present invention are described, for example, in *Research Disclosure*, No. 17643, page 28 and ibid., No. 18716, page 647, right column to page 648, left column, as mentioned above. Among them, reflective supports are preferred.

Now, color development processing which can be applied to the color photographic light-sensitive material according to the present invention will be described below.

A color developing solution which can be used in development processing of the color photographic light-sensitive material according to the present invention is an alkaline aqueous solution preferably containing an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride or p-toluenesulfonate thereof.

Two or more kinds of color developing agents may be employed in a combination thereof, depending on the purpose.

The color developing solution can ordinarily contain pH buffering agents, such as carbonates, borates Other additives to the color developing solution or phosphates of alkali metals, and development inhibitors or anti-fogging agents such as bromides, iodides, benzimidazoles, benzothiazoles, or mercapto compounds. Further, if necessary, the color developing solution preferably contains various preservatives such as hydroxylamine, diethylhydroxylamine, sulfites, hydrazines, hydrazides, phenylsemicarbazides, triethanolamine, catechol sulfonic acids, or triethylenediamine(l,4-diazabicyclo[2,2,2]octane).

Of these compounds, hydrazines and hydrazides are preferably employed, and they correspond to the compounds represented by general formula (II) described in Japanese Patent Application No. 63-11295 with specific examples set forth on pages 27 to 47. The amount of these compounds added to the color developing solution is preferably from 0.01 g to 50 g, more preferably from 0.1 g to 30 g, per liter of the solution.

The amount of the hydroxylamines added to the color developing solution is preferably from 0 g to 10 g, more preferably from 0 g to 5 g, per liter of the solution. It is preferred to minimize the amount of the hydroxylamines added to within the range wherein the stability of the color developing solution is maintained. include organic solvents such as ethyleneglycol, or diethylene glycol; development accelerators such as benzyl alcohol, polyethylene glycol, quarternary ammonium salts, or amines; dye forming couplers; competing couplers, fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenedimaine-di(o-hydroxyphenylacetic acid), and salts thereof.

The processing temperature of the color developing solution used in the present invention is preferably from 30 to 50° C, more preferably from 33 to 42° C. The amount of a replenisher for the color developing solution is generally at most 2,000 ml, preferably at most 1,500 ml, per m2 of the color photographic light-sensitive material. The amount of replenishment used is preferably selected as smallas possible from a standpoint of decreasing waste solution.

In the color development processing used in the present invention, it is preferred to use for rapid processing a color developing solution whic does not substantially contain benzyl alcohol, which is disadvantageous in view of environmental pollution, preservability of color image formed, and occurrence of stain. For such a purpose, a color development system wherein a restorer for an oxidation product of a color developing agent and a capturer for an oxidation product of the restorer are used in combination as described in Japanese Patent Application No. 61-259799 (corresponding to JP-A-63-113537) is preferably employed Moreover, the color developing solution used in the present invention preferably does not substantially contain an iodide ion The terminology 'color developing solution which does not substantially contain an iodide ion' as used herein means a color developing solution which contains less than 1 mg of an iodide ion per liter of the solution Furthermore, the color developing solution used in the present invention preferably does not substantially contain a sulfite ion. The terminology 'color developing solution which does not substantially contain a sulfite ion" as used herein means a color developing solution which contains not more than 0.02 mol of a sulfite ion per liter of the solution.

After color development, the photographic emulsion layers are usually subjected to bleach processing. The bleach processing can be performed simultaneously with a fix processing (bleach-fix processing), or it can be performed independently from the fix processing. Further, for the purpose of rapid processing, a processing method wherein after bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III), cobalt(III), chromium(VI), or copper(II); peracids; quinones; or nitro compounds. Representative examples of the bleaching agents include ferricyanides; dichromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid); persulfates; bromates; permanganates; or nitrobenzenes. Of these compounds, iron(III) complex salts of aminopolycarboxylic acids represented by an iron(III) complex salt of ethylenediaminetetraacetic acid and persulfates are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at a pH lower than the above described range.

In the bleaching solution, the bleach-fixing solution or a prebath thereof, a bleach accelerating agent can be used, if desired Specific examples of suitable bleach accelerating agents include compounds having a mercapto group or a disulfide bond as described, for example, in U.S. Pat. No. 3,893,858, West German Patent 1,290,812, JP-A-53-95630, and *Research Disclosure,* No. 17129 (July 1978); thiazolidine derivatives as described, for example, in JP-A-50-14029; thiourea derivatives as described, for example, in U.S. Pat. No. 3,706,561; iodides as described, for example, in JP-A-58-16235; polyoxyethylene compounds as described, for example, in West German Patent 2,748,430; polyamine compounds as described, for example, in JP-B-45-8836; and bromide ions Of these compounds, the compounds having a mercapto group or a disulfide bond are preferred in view of their large bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photographing are subjected to bleach-fix processing.

As fixing agents which can be employed in the fixing solution or bleach-fixing solution, thiosulfates, thiocyanate, thioether compounds, thioureas, or a large amount of iodide are exemplified of these compounds, thiosulfates are generally employed. Particularly, ammonium thiosulfate is the most widely employed compound. It is preferred to use sulfites, bisulfites, sulfinic acids or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on the characteristics of the photographic light-sensitive materials (due to elements used therein, for example, couplers, etc.), uses thereof, the temperature of the washing water, the number of water washing tanks (stages), the replenishment system such as countercurrent or orderly current, or other various conditions. The relationship between the number of water washing tanks and the amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increasing the amount of time that the water remains in a tank may cause the propagation of bacteria and other problems such as the adhesion of floatage formed on the photographic materials. In the method of processing the silver halide color photographic material according to the present invention, a method for reducing the amounts of calcium ions and magnesium ions as described in Japanese Patent Application No. 61-131632 (corresponding to JP-A-62-288838) can be particularly effectively employed in order to solve such problems. Further, sterilizers, for example, isothiazolone compounds as described in JP-A-57-8542, thiabenzazoles, chlorine type sterilizers such as sodium chloroisocyanurate, benzotriazoles, sterilizers as described in Hiroshi Horiguchi, *Bokin-Bobaizai No Kaqaku, Biseibutsu No Mekkin-, Sakkin, Bobai-Gijutsu,* edited by Eiseigijutsu Kai, and *Bokin-Bobaizai Jiten,* edited by Nippon Bokin-Bobai Gakkai can be employed.

The pH of the washing water used in the processing of the photographic light-sensitive materials according to the present invention is usually from 4 to 9, preferably from 5 to 8. The temperature of the washing water and the time for the water washing step can be variously set depending on the characteristics or uses of the photographic light-sensitive materials. However, it is general to select a temperature range of from 15 to 45° C. and a time period from 20 sec. to 10 min. and preferably a temperature range of from 25 to 40° C. and a time period from 30 sec. to 5 min.

The photographic light-sensitive material of the present invention can also be directly processed with a stabilizing solution in place of the above-described water washing step. In such a stabilizing process, any of the known methods as described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formal in and a surface active agent, which is employed as a final bath in the processing of color photographic light-sensitive materials for photographing. To such a stabilizing bath, various chelating agents and antimold agents may also be added.

Overflow solution resulting from the replenishment of the above-described washing water and/or stabilizing solution may be used in other steps, such as in a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of color developing agents include indoaniline type compounds as described in U.S. Pat. Nos. 3,342,597, Schiff's base type compounds as described in U.S. Pat. No. 3,342,599 and *Research Disclosure,* No. 14850 and *ibid.,* No. 15159, aldol compounds as described in *Research Disclosure,* No. 13924, metal salt complexes as described in U.S.

Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of such compounds include those as described, for example, in JP-A-56-64339, JP-A-57-144547, and JP-A-58-115438.

In the present invention, various kinds of processing solutions can be employed in a temperature range from 10° C. to 50° C. Although a standard temperature is from 33 to 38° C, it is possible to carry out the processing at higher temperatures in order to accelerate the processing whereby the processing time is shortened, or at lower temperatures in order to achieve an improvement in the image quality and to maintain the stability of the processing solutions.

Further, for the purpose of saving the amount of silver employed in the color photographic light-sensitive material, the photographic processing may be conducted by utilizing color intensification with cobalt or hydrogen peroxide as described in West German Patent 2,226,770 or U.S. Pat. No. 3,674,499.

In the color development processing, a color development step, a desilvering step, a water washing step and a drying step can be carried out within 120 seconds.

The present invention can be applied to various color photographic light-sensitive materials. Representative examples include color negative films for general use or movies, color reversal films for slides or television, color paper, color positive films and color reversal paper. The present invention can also be applied to black-and-white photographic light-sensitive materials utilizing a mixture of three color couplers as described, for example, in *Research Disclosure,* No. 17123 (July, 1978). The present invention is preferably applied to reflective type color photographic light-sensitive materials such as color paper and color reversal paper.

In accordance with the combination of the specific magenta coupler represented by general formula (I) and the specific dialkoxybenzene derivative represented by general formula (II) used in the present invention, the preservability of the photographic image is greatly improved. Specifically, magenta color images obtained by processing the silver halide color photographic material of the present invention exhibit extremely high fastness to light.

The present invention will now be explained in greater detail with reference to the following examples, but it should be understood that these examples are not limiting the present invention.

EXAMPLE 1

To a mixture of 20 ml of tricresyl phosphate and 20 ml of ethyl acetate was dissolved 10 g of Magenta Coupler (a), i.e., 1-(2,4,6-trichlorophenyl)-3[(2-chloro-5-tetradecaneamido)aniliino]-2-pyrazolin-5-one. The solution was emulsified and dispersed in 80g of an aqueous gelatin solution containing 8 ml of a 1% aqueous solution of sodium dodecylbenzenesulfonate.

The resulting emulsified dispersion was mixed with 145 g of a green-sensitive silver chlorobromide emulsion (bromide content: 50 mol %; Ag content: 7 g), and sodium dodecylbenzenesulfontate was added thereto as a coating aid. The resulting mixture was coated on a paper support laminated on both sides thereof with polyethlene to a coupler coating a gelatin protective layer to a gelatin coating amount of 1 g/m$^2$. The resulting sample was designated Sample 1-A.

The same procedure as described above was repeated except that the emulsified dispersion was prepared by using a combination of the coupler represented by general formula (I) according to the present invention or the comparative magenta coupler (a) and the compound represented by general formula (II) according to the present invention, or a comparative compound as shown in Table 1 below. The compound of general formula (II) of the comparative compound was added in an amount of 100 mol % based on the coupler used. The resulting samples were designated Samples 1-B to 1-Q.

Each of the above-described samples was exposed to light through an optical wedge and then subjected to development processing according to the following processing steps.

| Processing Step | Temperature (°C.) | Time |
|---|---|---|
| Color Development | 37 | 3 min. 30 sec. |
| Bleach-Fixing | 33 | 1 min. 30 sec |
| Washing with Water | 24 to 34 | 3 min. |
| Drying | 70 to 80 | 1 min. |

The composition of each processing solution used was as follows:

| | |
|---|---|
| Color Developing Solution: | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Brightening agent (WHITEX 4B manufactured by Sumitomo Chemical Co., Ltd.) | 1.0 g |
| Water to make | 1000 ml |
| pH (25° C.) | 10.25 |
| Bleach-Fixing Solution: | |
| Water | 400 ml |
| Ammonium thiosulfate (70% aqueous solution) | 150 ml |
| Sodium sulfite | 18 g |
| Ammonium ethylenediaminetetra-acetato ferrate | 55 g |
| Disodium ethylenediamine-tetraacetate | 5 g |
| Water to make | 1000 ml |
| pH (25° C.) | 6.70 |

The sample having the dye image thus-formed thereon was subjected to a fading test for 6 days through an ultraviolet ray absorbing filter manufactured by Fuji Photo Film Co., Ltd. which cut light of 400 nm or less using a xenon tester (illuminance: 200,000 lux). The remaining density at the area having an initial density of 2.0 or 1.0 was measured using a Macbeth densitometer, RD-514 model (Status AA filter). The results obtained are shown in Table 1.

TABLE 1

| Sample No. | Magenta Coupler | Color Image Stabilizer | Magenta Density Initial Density: 2.0 | Magenta Density Initial Density: 1.0 | Remark |
|---|---|---|---|---|---|
| 1-A | Comparative Magenta Coupler (a) | — | 0.27 | 0.22 | Comparison |
| 1-B | Comparative Magenta Coupler (a) | A-2 | 0.85 | 0.50 | " |
| 1-C | Comparative Magenta Coupler (a) | A-3 | 0.79 | 0.51 | " |
| 1-D | M-4 | — | 0.20 | 0.12 | " |
| 1-E | " | A-3 | 1.80 | 0.85 | Present Invention |
| 1-F | " | A-6 | 1.78 | 0.82 | Present Invention |
| 1-G | " | A-13 | 1.79 | 0.85 | Present Invention |
| 1-H | " | Comparative Compound (A) | 1.65 | 0.79 | Comparison |
| 1-I | " | Comparative Compound (B) | 1.50 | 0.70 | " |
| 1-J | " | Comparative Compound (C) | 0.80 | 0.30 | " |
| 1-K | " | Comparative Compound (D) | 1.60 | 0.70 | " |
| 1-L | M-9 | — | 0.25 | 0.09 | " |
| 1-M | " | A-13 | 1.82 | 0.85 | Present Invention |
| 1-N | M-9 | Comparative Compound (A) | 1.67 | 0.80 | Comparison |
| 1-O | M-12 | — | 0.30 | 0.10 | " |
| 1-P | " | A-2 | 1.83 | 0.85 | Present Invention |
| 1-Q | " | A-25 | 1.82 | 0.82 | Present Invention |

Comparative Compound (A):

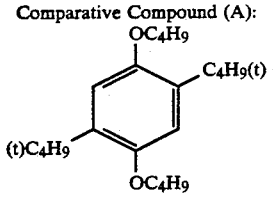

(compound described in JP-A-60-262159)

Comparative Compound (B):

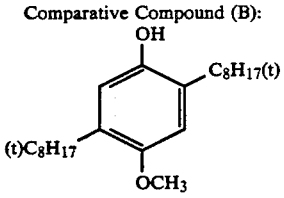

(compound described in British Patent 2,066,975B)

Comparative Compound (C):

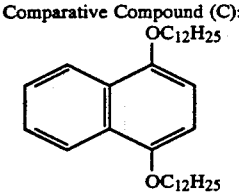

(compound described in JP-A-61-292144)

Comparative Compound (D):

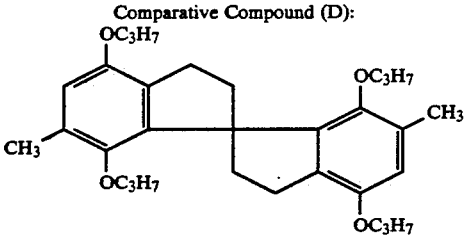

-continued (compound described in JP-A-62-244046)

Comparative Magenta Coupler (a):

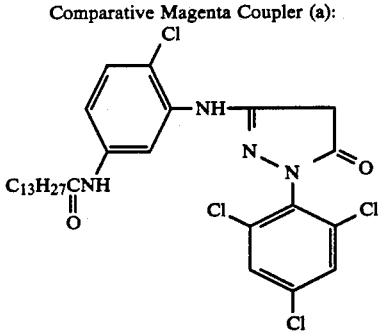

From the results shown in Table 1 above, it can be seen that the samples according to the present invention exhibit a superior light fading preventing effect, particularly in a high density area, as compared with the samples using known color fading preventing agents.

EXAMPLE 2

Using M-4 as a magenta coupler, a multilayer Sample 2-A was prepared according to the procedure described below. Further, in the same manner as described for Sample 2-A, multilayer Samples 2-B to 2-G were prepared by adding the comparative compound or the color image stabilizer according to the present invention as shown in Table 2 below to the third layer in an amount of 100 mol % based on the magenta coupler.

Silver Halide Emulsion (1) used in the blue-sensitive silver halide emulsion layer was prepared in the following manner.

| | |
|---|---|
| Solution 1 | |
| $H_2O$ | 1,000 ml |
| NaCl | 8.8 g |
| Gelatin | 25 g |
| Solution 2 | |
| Sulfuric acid (1N) | 20 ml |
| Solution 3 | |
| A compound (1%) of the formula: | 3 ml |

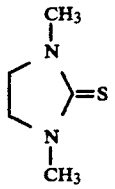

| | |
|---|---|
| Solution 4 | |
| KBr | 14.01 g |
| NaCl | 1.72 g |
| $H_2O$ to make | 130 ml |
| Solution 5 | |
| $AgNO_3$ | 25 g |
| $H_2O$ to make | 130 ml |
| Solution 6 | |
| KBr | 56.03 g |
| NaCl | 6.88 g |
| $K_2IrCl_6$ (0.001%) | 1.0 ml |
| $H_2O$ to make | 285 ml |
| Solution 7 | |
| $AgNO_3$ | 100 g |
| $NH_4NO_3$ (50%) | 2 ml |
| $H_2O$ to make | 285 ml |

Solution 1 was heated at 75° C., Solution 2 and Solution 3 were added thereto and then Solution 4 and Solution 5 were simultaneously added thereto over a period of 40 minutes. After 10 minutes, Solution 6 and Solution 7 were simultaneously added over a period of 25 minutes. After 5 minutes, the temperature was lowered and the mixture was de-salted. Water and gelatin for dispersion were added thereto and the pH was adjusted to 6.2, whereby a monodisperse cubic silver chlorobromide emulsion (Silver Halide Emulsion (1)) was obtained (having an average grain size of 1.01 μm, a coefficient of variation [a value obtained by dividing the standard deviation with the average grain size: s/d̄] of 0.08 and a silver bromide content of 80 mol%). The emulsion was subjected to an optimum chemical sensitization using triethylthiourea so as to form a surface latent image type emulsion.

Silver Halide Emulsion (2) used in the blue-sensitive silver halide emulsion layer, Silver Halide Emulsions (3) and (4) used in the green-sensitive silver halide emulsion layer and Silver Halide Emulsions (5) and (6) used in the red-sensitive silver halide emulsion layer were prepared in the same manner a described above except changing the amounts of chemicals, temperature and time for addition, respectively.

The crystal form, average grain size, halogen composition and coefficient of variation of each of Silver halide Emulsions (1) to (6) are shown below.

| Emulsion | Crystal Form | Average Grain Size (μm) | Halogen Composition (Br mol %) | Coefficient of Variation |
|---|---|---|---|---|
| (1) | cubic | 1.01 | 80 | 0.08 |
| (2) | cubic | 0.70 | 80 | 0.07 |
| (3) | cubic | 0.52 | 80 | 0.08 |

-continued

| Emulsion | Crystal Form | Average Grain Size (μm) | Halogen Composition (Br mol %) | Coefficient of Variation |
|---|---|---|---|---|
| (4) | cubic | 0.40 | 80 | 0.09 |
| (5) | cubic | 0.44 | 70 | 0.09 |
| (6) | cubic | 0.36 | 70 | 0.08 |

On a paper support, both surfaces of which were laminated with polyethylene, were coated layers as described below in order to prepare a multilayer color photographic light-sensitive material. The coating solutions were prepared in the following manner.

Preparation of Coating Solution for First Layer 19.1 g of Yellow Coupler (ExY), 1.91 g of Color Image Stabilizer (Cpd-1) and 0.46 g of Antifogging Agent (Cpd-2) were dissolved in a mixture of 27.2 ml of ethyl acetate, 3.8 ml of Solvent (Solv-1) and 3.8 ml of Solvent (Solv-2), and the resulting solution was emulsified and dispersed in 185 ml of a 10% aqueous solution of gelatin containing 8 ml of a 10% aqueous solution of sodium dodecylbenzenesulfonate. Separately, to a mixture of Silver Halide Emulsion (1) and Silver Halide Emulsion (2) in a mixing ratio of 6:4 was added $5.0\times10^{-4}$ mols of a blue-sensitive sensitizing dye shown below per mol of silver to prepare a blue-sensitive emulsion. The above described emulsified dispersion was mixed with the blue-sensitive silver halide emulsion, with the concentration of the resulting mixture being controlled to form the composition shown below, i.e., the coating solution for the first layer.

Coating solutions for the second layer to the seventh layer were prepared in a similar manner as described for the coating solution for the first layer.

2-Oxy-3,5-dichloro-s-triazine sodium salt was used as a gelatin hardener in each layer.

The following spectral sensitizing dyes were employed in the emulsion layers, respectively.

Blue Sensitive Emulsion Layer

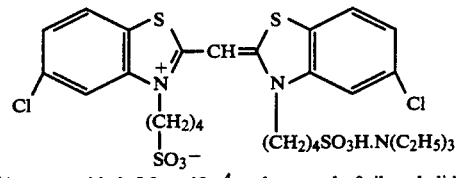

(Amount added: $5.0\times10^{-4}$ mol per mol of silver halide)

Green Sensitive Emulsion Layer

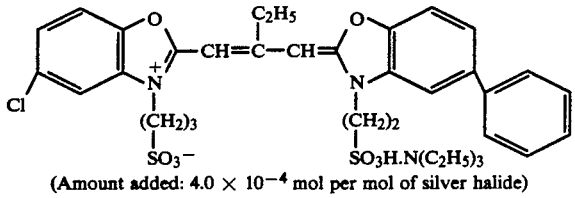

(Amount added: $4.0\times10^{-4}$ mol per mol of silver halide)

and

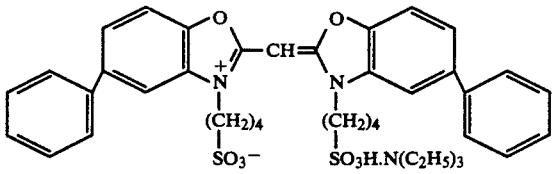

-continued (Amount added: $7.0 \times 10^{-5}$ mol per mol of silver halide)

Red Sensitive Emulsion layer

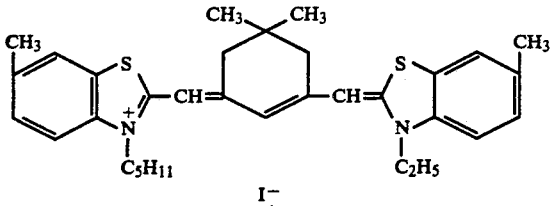

(Amount added: $0.9 \times 10^{-4}$ mol per mol of silver halide)

To the red-sensitive emulsion layer was added the compound described below in an amount of $2.6 \times 10^{-3}$ mol per mol of silver halide.

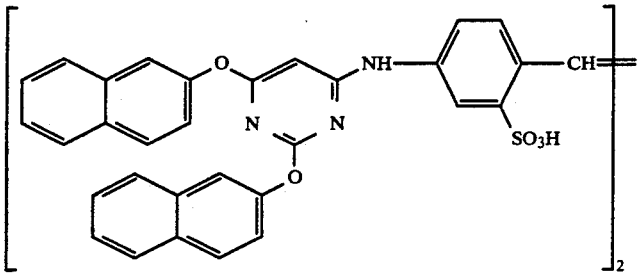

Also, to the blue-sensitive emulsion layer and to the green-sensitive emulsion layer was added 4-hydroxy-6-methyl-1,3,3a,7-tetraazaindene in amounts of $1.2 \times 10^{-2}$ and $1.1 \times 10^{-2}$ mol per mol of silvef halide, respectively.

Further, to the green-sensitive emulsion layer was added 1-(5-methylureidophyenyl)-4-mercaptotetrazole in an amount of $1.0 \times 10^{-3}$ mol per mol of silver halide.

Moreover, to the red-sensitive emulsion layer was added 2-amino-5-mercapto-1,3,4-thiadiazole in an amount of $3.0 \times 10^{-4}$ mol per mol of silver halide.

Furthermore, as irradiation preventing dyes, Dyes T-1 and T-2 described below were employed.

Layer Construction

The composition of each layer is shown below. The numerical values denote the coating amounts of the components in g/m². The coating amount of the silver halide emulsion is indicated in terms of the silver coating amount.

| | | |
|---|---|---|
| Support | Paper support, both surfaces of which were laminated with polyethylene (the polyethylene coating containing a white pigment ($TiO_2$) and a bluish dye (ultramarine) on the first layer side) | |
| First Layer (Blue-sensitive layer) | Silver Halide Emulsions (1) and (2) | 0.26 |
| | Gelatin | 1.20 |
| | Yellow Coupler (ExY) | 0.66 |
| | Color Image Stabilizer (Cpd-1) | 0.07 |
| | Antifogging Agent (Cpd-2) | 0.02 |
| | Solvent (Solv-1) | 0.13 |
| | Solvent (Solv-2) | 0.13 |
| Second Layer (Color mixing Preventing layer) | Gelatin | 1.34 |
| | Color Fading Preventing Agent (Cpd-3) | 0.04 |
| | Solvent (Solv-3) | 0.10 |
| | Solvent (Solv-4) | 0.10 |
| Third Layer (Green-Sensitive layer) | Silver Halide Emulsions (3) and (4) | 0.14 |
| | Gelatin | 1.30 |
| | Magenta Coupler (M-4) | 0.27 |
| | Anti-Staining Agent (Cpd 11) | 0.025 |
| | Anti-Staining Agent (Cpd-12) | 0.032 |
| | Solvent (Solv-3) | 0.21 |
| | Solvent (Solv-5) | 0.33 |
| Fourth Layer | Gelatin | 1.44 |

T-1

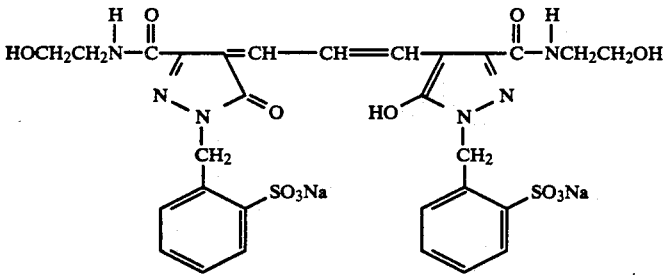

T-2

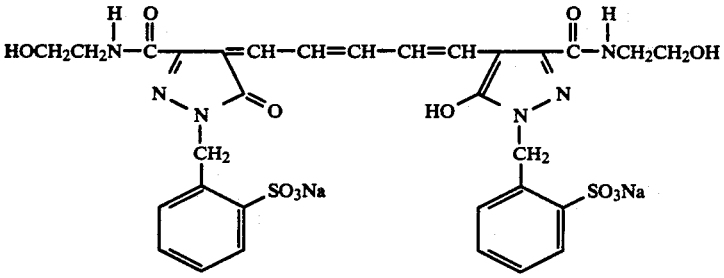

-continued

| | | |
|---|---|---|
| (Ultraviolet light Absorbing layer) | Ultraviolet Light Absorbing Agent (UV-1) | 0.53 |
| | Color Mixing Preventing Agent (Cpd-2) | 0.05 |
| | Solvent (Solv-2) | 0.26 |
| Fifth Layer (Red-sensitive layer) | Silver Halide Emulsions (5) and (6) | 0.20 |
| | Gelatin | 0.89 |
| | Cyan Coupler (ExC-1) | 0.13 |
| | Cyan Coupler (ExC-2) | 0.16 |
| | Color Image Stabilizer (Cpd-1) | 0.27 |
| | Color Image Stabilizer (Cpd-7) | 0.07 |
| | Antifogging Agent (Cpd-2) | 0.01 |
| | Solvent (Solv-1) | 0.19 |
| Sixth Layer (Ultraviolet light Absorbing layer) | Gelatin | 0.47 |
| | Ultraviolet Light Absorbing Agent (UV-1) | 0.17 |
| | Solvent (Solv-2) | 0.08 |
| Seventh Layer (Protective layer) | Gelatin | 1.25 |
| | Acryl-modified Polyvinyl Alcohol Copolymer (Degree of modification: 17%) | 0.05 |
| | Liquid Paraffin | 0.02 |

The compounds used in the above-described layers have the structures shown below, respectively.

Yellow Coupler (ExY)

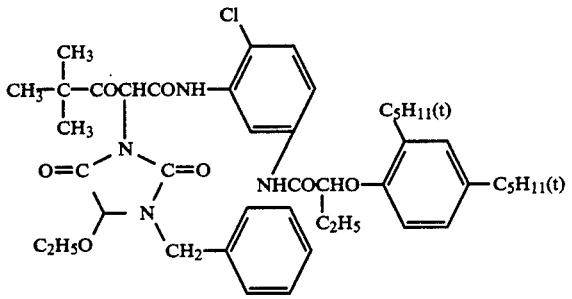

Cyan Coupler (ExC-1)

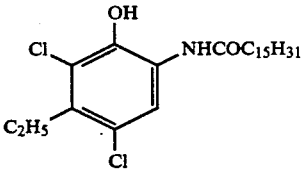

Cyan Coupler (ExC-2)

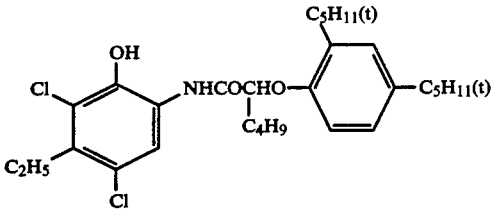

Color Image Stabilizer (Cpd-1)

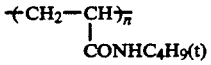

(average molecular weight: 60,000)

Antifogging Agent (Cpd-2)

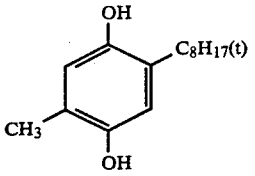

Color Mixing Preventing Agent (Cpd-3)

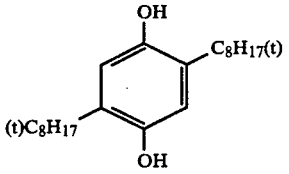

Anti-Staining Agent (Cpd-11)

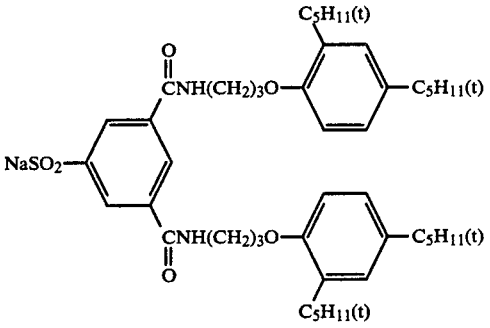

Anti-Staining Agent (Cpd-12)

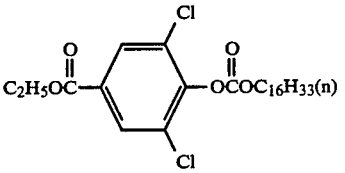

Color Image Stabilizer (Cpd-7)

A mixture of

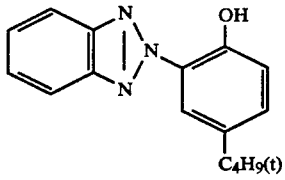

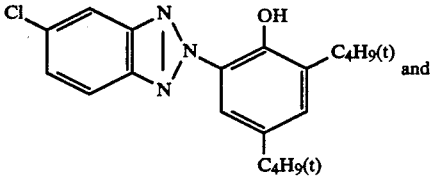

and

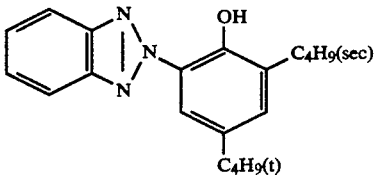

in a weight ratio of 4:2:5.

-continued

Ultraviolet Light Absorbing Agent (UV-1)

A mixture of

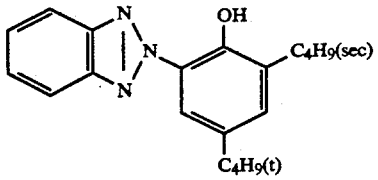

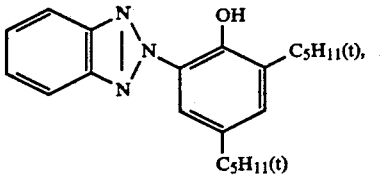

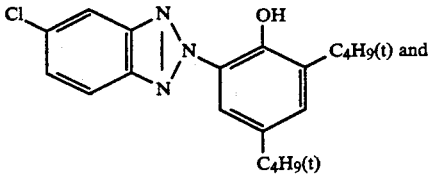

in a weight ratio of 12:10:3.

Solvent (Solv-1)

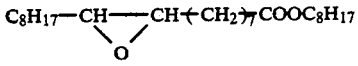

Sovent (Solv-2)

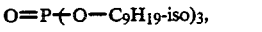

Solvent (Solv-3)

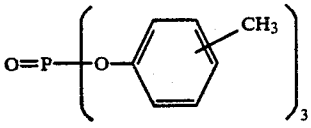

Solvent (Solv-4)

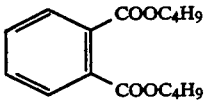

Solvent (Solv-5)

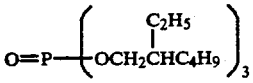

Each of the samples thus prepared was subjected to light exposure and development processing in the same manner as described in Example 1. The sample having formed thereon a dye image was subjected to a fading test using a fluorescent lamp fade tester (15,000 lux) for 4 weeks. The remaining density at the area having an initial density of 2.0 was measured. The results thus obtained are shown in Table 2.

TABLE 2

| Sample No. | Color Image Stabilizer | Magenta Density Initial Density: 2.0 | Remark |
|---|---|---|---|
| 2-A | — | 1.20 | Comparison |
| 2-B | Comparative Compound (A) | 1.62 | " |
| 2-C | Comparative Compound (C) | 1.30 | " |
| 2-D | Comparative Compound (E) | 1.65 | " |
| 2-E | Compound of the Invention (A-3) | 1.86 | Present Invention |
| 2-F | Compound of the Invention (A-6) | 1.85 | Present Invention |
| 2-G | Compound of the Invention (A-13) | 1.82 | Present Invention |

Comparative Compound (E):

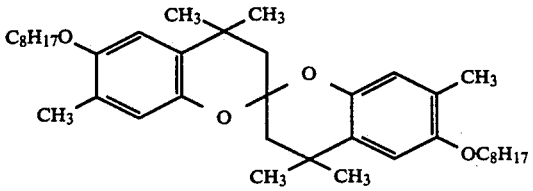

(compound described in JP-A-60-262159)

From the results shown in Table 2 above, it can be seen that the samples according to the present invention exhibit a particularly excellent light fastness improving effect in comparison with the samples using the known color fading preventing agent.

EXAMPLE 3

Using M-4 as a magenta coupler, a multilayer Sample 3-A was prepared according to the procedure shown below. Further, in the same manner as described for Sample 3-A, multilayer Samples 3-B to 3-G were prepared by adding the comparative compound or the color image stabilizer according to the present invention as shown in Table 3 below to the third layer in an amount of 100 mol % based on the magenta coupler.

Silver Chlorobromide Emulsion (1) used in the blue-sensitive silver chlorobromide emulsion layer was prepared in the following manner.

| | |
|---|---|
| Solution 1 | |
| $H_2O$ | 1,000 ml |
| NaCl | 5.8 g |
| Gelatin | 25 g |
| Solution 2 | |
| Sulfuric acid (1N) | 20 ml |
| Solution 3 | |
| A compound (1%) of the formula: | 3 ml |

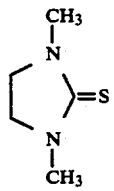

| | |
|---|---|
| Solution 4 | |
| KBr | 0.18 g |
| NaCl | 8.51 g |
| $H_2O$ to make | 130 ml |
| Solution 5 | |
| $AgNO_3$ | 25 g |
| $H_2O$ to make | 130 ml |
| Solution 6 | |

-continued

| | |
|---|---|
| KBr | 0.70 g |
| NaCl | 34.05 g |
| $K_2IrCl_6$ (0.001%) | 2 ml |
| $H_2O$ to make | 285 ml |
| Solution 7 | |
| $AgNO_3$ | 100 g |
| $H_2O$ to make | 285 ml |

Solution 1 was heated to 60° C, Solution 2 and Solution 3 were added thereto and then Solution 4 and Solution 5 were simultaneously added thereto over a period of 60 minutes. After 10 minutes, Solution 6 and Solution 7 were simultaneously added over a period of 25 minutes. After 5 minutes, the temperature was lowered and the mixture was de-salted. Water and gelatin for dispersion were added thereto and the pH was adjusted to 6.0, whereby a monodisperse cubic silver chlorobromide emulsion was obtained (having an average grain size of 1.0 μm, a coefficient of variation [a value obtained by dividing the standard deviation with the average grain size: s/d] of 0.11 and a silver bromide content of 1 mol %). The emulsion was subjected to an optimum chemical sensitization using triethylthiourea so as to form a surface latent image type emulsion, whereby Silver Chlorobromide Emulsion (1) was prepared. Then, a Spectral Sensitizing Dye (Sen-1) shown below was added to Silver Chlorobromide Emulsion (1) in an amount of $7\times10^{-4}$ mol per mol of silver halide.

Silver Chlorobromide Emulsion (2) used in the green-sensitive silver chlorobromide emulsion layer and, Silver Chlorobromide Emulsion (3) used in the red-sensitive silver chlorobromide emulsion layer were prepared in the same manner as described above except changing the amounts of chemicals, temperature and time for addition, respectively.

To Silver Chlorobromide Emulsion (2) was added Spectral Sensitizing Dye (Sen-2) in an amount of $5\times10^{-4}$ mol per mol of silver halide, and to Silver Chlorobromide Emulsion (3) was added Spectral Sensitizing Dye (Sen-3) in an amount of 0.9xl0-4 mol per mol of silver halide.

The crystal form, average grain size, halogen composition and coefficient of variation of each of Silver Chlorobromide Emulsions (1) to (3) are shown below.

| Emulsion | Crystal Form | Average Grain Size (μm) | Halogen Composition (Br mol %) | Coefficient of Variation |
|---|---|---|---|---|
| (1) | cubic | 1.00 | 1.0 | 0.11 |
| (2) | cubic | 0.45 | 1.0 | 0.09 |
| (3) | cubic | 0.34 | 1.8 | 0.10 |

(Sen-1)

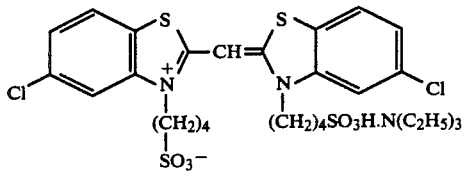

(Sen-2)

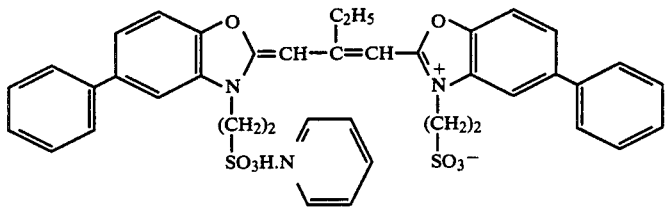

(Sen-3)

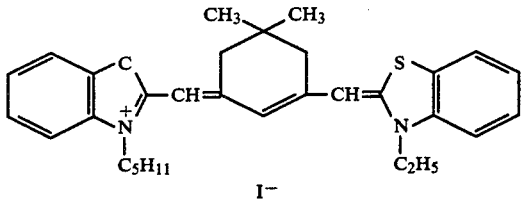

Using Silver Chlorobromide Emulsions (1) to (3) thus prepared, a multilayer color photographic light-sensitive material having a layer construction shown below was prepared. The coating solutions were prepared in the following manner.

Preparation of Coating Solution for First layer 19.1 of Yellow Coupler (ExY) was dissolved in a mixture of 27.2 ml of ethyl acetate and 3.8 ml of Solvent (Solv-1) and the resulting solution was emulsified and dispersed in 185 ml of a 10% aqueous solution of gelatin containing 8 ml of a 10% aqueous solution of sodium dodecylbenzenesulfonate. Separately, to a mixture of Silver Chlorobromide Emulsion (1) was added $5.0\times10^{-4}$ mol of a blue-sensitive sensitizing dye (Sen-1) per mol of silver to prepare a blue-sensitive emulsion. The above described emulsified dispersion was mixed with the blue-sensitive silver halide emulsion with the concentration of the resulting mixture being controlled to form the composition shown below, i.e., the coating solution for the first layer.

Coating solutions for the second layer to the seventh layer were prepared in a similar manner as described for the coating solution for the first layer.

2-Oxy-3,5-dichloro-s-triazine sodium salt was used as a gelatin hardener in each layer.

To the red-sensitive emulsion layer was added the compound described below in an amount of 1.9x10-3 mol per mol of silver chlorobromide.

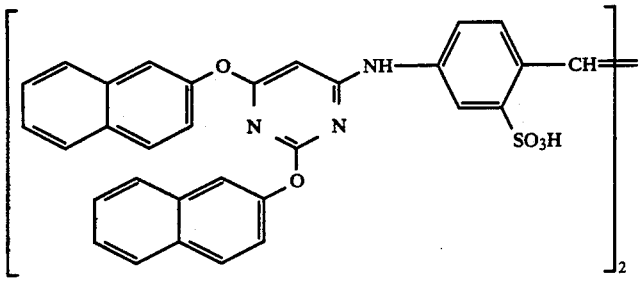

Also, to the blue-sensitive emulsion layer was added 4-hydroxy-6-methyl-l, 3, 3a, 7-tetraazaindene in an amount of $1.0\times10^{-2}$ mol per mol of silver chlorobromide.

Further, to the blue-sensitive emulsion layer and to the green-sensitive emulsion layer was added 1-5-methylureidophenyl)-5-mercaptotetrazole in the amount of $1.0\times10^{\times3}$ and $1.5\times10^{-3}$ mol per mol of silver chlorobromide, respectively.

Moreover, to the red-sensitive emulsion layer was added 2-amino-5-mercapto-l, 3, 4-thiadiazole in an amount of 2.5×10−4 mol per mol of silver chlorobromide.

Layer Construction

The composition of each layer is shown below.

| | | |
|---|---|---|
| Support | Paper support, both surfaces of which were laminated with polyethylene (the polyethylene coating containing a white pigment ($TiO_2$: 2.7 g/m$^2$) and a bluish dye (ultramarine) on the first layer side) | |
| First Layer (Blue-sensitive layer) | Silver Chlorobromide Emulsion (1) | 0.26 |
| | Gelatin | 1.13 |
| | Yellow Coupler (ExY) | 0.66 |
| | Solvent (Solv-4) | 0.28 |
| Second Layer (Color mixing Preventing layer) | Gelatin | 0.89 |
| | Color Mixing Preventing Agent (Cpd-3) | 0.08 |
| | Solvent (Solv-4) | 0.20 |
| | Solvent (Solv-3) | 0.20 |
| | Dye (T-3) | 0.005 |
| Third Layer (Green-Sensitive layer) | Silver Chlorobromide Emulsion (2) | 0.15 |
| | Gelatin | 0.51 |
| | Magenta Coupler (M-4) | 0.27 |
| | Color Image Stabilizer (Cpd-5) | 0.05 |
| | Color Image Stabilizer (Cpd-6) | 0.07 |
| | Color Image Stabilizer (Cpd-8) | 0.01 |
| | Solvent (Solv-3) | 0.19 |
| | Solvent (Solv-5) | 0.15 |
| Fourth Layer (Ultraviolet light Absorbing layer) | Gelatin | 1.42 |
| | Ultraviolet Light Absorbing Agent (UV-1) | 0.52 |
| | Color Mixing Preventing Agent (Cpd-3) | 0.06 |
| | Solvent (Solv-2) | 0.26 |
| | Dye (T-2) | 0.015 |
| Fifth Layer (Red-sensitive layer | Silver Chlorobromide Emulsion (3) | 0.22 |
| | Gelatin | 1.06 |
| | Cyan Coupler (ExC-1) | 0.16 |
| | Cyan Coupler (ExC-2) | 0.13 |
| | Color Image Stabilizer (Cpd-1) | 0.32 |
| | Color Image Stabilizer (Cpd-7) | 0.18 |
| | Solvent (Solv-2) | 0.10 |
| | Solvent (Solv-6) | 0.10 |
| | Solvent (Solv-7) | 0.11 |
| Sixth Layer (Ultraviolet | Gelatin | 0.48 |
| | Ultraviolet Light Absorbing Agent | 0.18 |

-continued

| | | |
|---|---|---|
| light Absorb-ing layer) | (UV-1) | |
| | Solvent (Solv-2) | 0.08 |
| | Dye (T-2) | 0.005 |
| Seventh Layer (Protective layer) | Gelatin | 1.33 |
| | Acryl-modified Polyvinyl Alcohol Copolymer (Degree of modification: 17%) | 0.05 |
| | Liquid Paraffin | 0.03 |

The additives used in the above-described layers have the chemical structural formulae shown below, respectively, except for those employed in Example 2 above.

Color Image Stabilizer (Cpd-5)

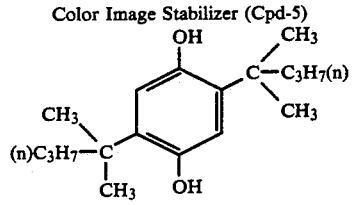

Color Image Stabilizer (Cpd-6)

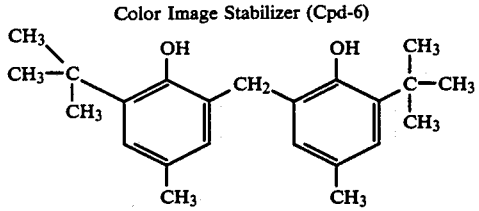

Color Image Stabilizer (Cpd-8)

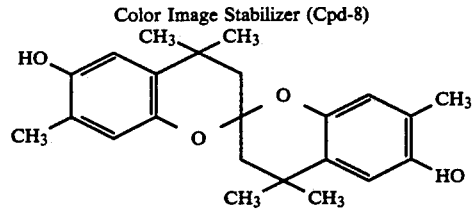

Cyan Coupler (ExC-1)

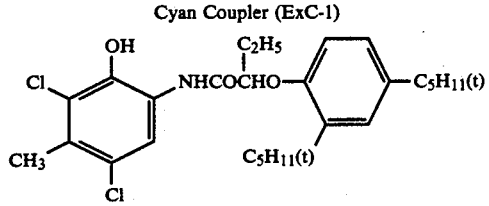

Cyan Coupler (ExC-2)

-continued

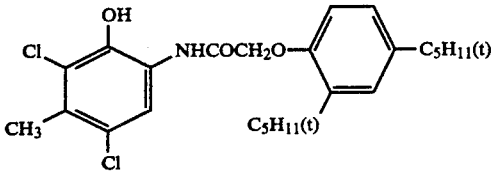

Solvent (Solv-6)

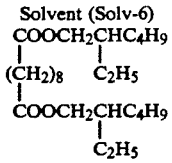

Solvent (Solv-7)

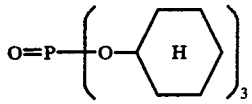

(T-3)

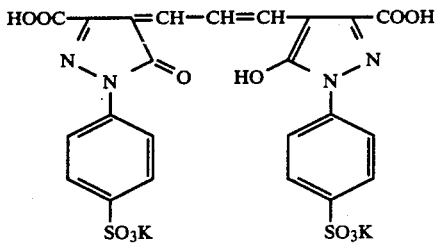

The photographic light-sensitive material thus prepared was exposed to light through an optical wedge and then was subjected to development processing according to the steps shown below.

| Processing Step | Temperature (°C.) | Time |
|---|---|---|
| Color Development | 35 | 45 sec. |
| Bleach-Fixing | 30 to 36 | 45 sec. |
| Stabilizing (1) | 30 to 37 | 20 sec. |
| Stabilizing (2) | 30 to 37 | 20 sec. |
| Stabilizing (3) | 30 to 37 | 20 sec. |
| Stabilizing (4) | 30 to 37 | 30 sec. |
| Drying | 70 to 85 | 60 sec. |

The stabilizing steps were conducted using a four-tank countercurrent system from Stabilizing (4) to Stabilizing (1).

The composition of each processing solution used was as follows:

| | |
|---|---|
| Color Developing Solution: | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostilbene type) | 2.0 g |
| Water to make | 1000 ml |
| pH (25° C.) | 10.10 |
| Bleach-Fixing Solution: | |
| Water | 400 ml |
| Ammonium thiosulfate (70%) | 100 ml |
| Sodium sulfite | 18 g |
| Ammonium ethylenediaminetetraacetato ferrate | 55 g |
| Disodium ethylenediamine-tetraacetate | 3 g |
| Glacial acetic acid | 8 g |
| Water to make | 1000 ml |
| pH (25° C.) | 5.5 |
| Stabilizing Solution | |
| Formaldehyde (37%) | 0.1 g |
| Formaldehyde-sulfite adduct | 0.7 g |
| 5-Chloro-2-methyl-4-isothiazolin-3-one | 0.02 g |
| 2-Methyl-4-isothiazolin-3-one | 0.01 g |
| Cupric sulfate | 0.005 g |
| Water to make | 1000 ml |
| pH (25° C.) | 4.0 |

The sample having formed thereon a dye image was subjected to fading test using a fluorescent lamp fade tester (15,000 lux) for 5 weeks. The remaining density in the area having an initial density of 2.0 was measured. The results obtained are shown in Table 3.

TABLE 3

| Sample No. | Color Image Stabilizer | Magenta Density Initial Density: 2.0 | Remark |
|---|---|---|---|
| 3-A | — | 1.05 | Comparison |
| 3-B | Comparative Compound (A) | 1.55 | " |
| 3-C | Comparative Compound (C) | 1.20 | " |
| 3-D | Comparative Compound (D) | 1.60 | " |
| 3-E | Compound of the Invention (A-2) | 1.88 | Present Invention |
| 3-F | Compound of the Invention (A-3) | 1.86 | Present Invention |
| 3-G | Compound of the Invention (A-6) | 1.85 | Present Invention |
| 3-H | Compound of the Invention (A-8) | 1.77 | Present Invention |
| 3-I | Compound of the Invention (A-25) | 1.90 | Present Invention |

From the results shown in Table 3 above, it can be seen that the samples according to the present invention exhibit a particularly excellent light fastness improving effect in comparison with the samples using the known color fading preventing agent.

EXAMPLE 4

Using M-3, M-5, M-9 and M-11 according to the present invention in place of the magneta coupler M-4 used in the third layer of the sample described in Example 3, the same test as described in Example 3 was conducted. As a result, it is recognized that the compounds according to the present invention exhibit the superior light fastness improving effect similar to Example 3.

EXAMPLE 5

The samples prepared in Examples 3 and 4 were exposed to light through an optical wedge, then were subjected to development processing according to the steps described below, and thereafter were subjected to the fading test in the same manner as described in Example 3. The compounds according to the present invention exhibit the superior light fastness improving effect similar to Examples 3 and 4.

| Processing Step | Temperature (°C.) | Time |
|---|---|---|
| Color Development | 35 | 45 sec. |
| Bleach-Fixing | 35 | 45 sec. |
| Washing with Water (1) | 35 | 30 sec. |
| Washing with Water (2) | 35 | 30 sec. |
| Washing with Water (3) | 35 | 30 sec. |
| Drying | 75 | 60 sec. |

The washing with water steps were conducted using a three-tank countercurrent system from Washing with Water (3) to Washing with Water (1).

The compositions of each processing solution used was as follows:

| Color Developing Solution: | Mother Solution | Replenisher |
|---|---|---|
| Water | 800 ml | 800 ml |
| Ethylenediamine N,N,N',N' tetramethylenephosphonic acid | 3.0 g | 3.0 g |
| Triethanolamine | 8.0 g | 12 g |
| Sodium chloride | 1.4 g | 0.3 g |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 5.0 g | 6.0 g |
| Brightening agent (UVITEX CK manufactured by Ciba-Geigy Co.) | 1.0 g | 2.0 g |
| Water to make | 1000 ml | 1000 ml |
| pH (25° C.) | 10.05 | |

| Bleach-Fixinq Solution: | |
|---|---|
| Water | 700 ml |
| Ammonium thiosulfate solution (700 g/l) | 100 ml |
| Ammonium sulfite | 18 g |
| Ammonium ethylenediaminetetraacetate ferrate dihydrate | 55 g |
| Disodium ethylenediaminetetraacetate | 3 g |
| Ammonium bromide | 40 g |
| Glacial acetic acid | 8 g |
| Water to make | 1000 ml |
| pH (25° C.) | 5.5 |

Washing Solution

City water was treated with an ion exchange resin so as to reduce the amount of calcium and magnesium to not more than 3 ppm, respectively. The dielectric constant of the water was 5 μs/cm at 25° C.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, the silver halide color photographic material containing at least one pyrazoloazole type coupler represented by general formula (I) and at least one compound represented by general formula (II):

Formula (I):

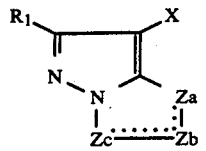

(I)

wherein $R_1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N- or -NH-, one of the Za—Zb bond and the Zb—Zc bond being a double bond and the other being a single bond; when the Zb—Zc bond is carbon-carbon double bond, the Zb—Zc bond may be a part of a condensed aromatic ring; Rl or X may also form a polymer including a dimer or more; and when Za, Zb or Zc is a substituted methine group, the substituted methine group may form a polymer including a dimer or more;

Formula (II):

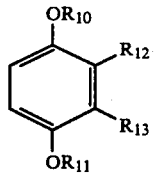

(II)

wherein $R_{10}$ and $R_{11}$, which may be the same or different, each represents an aliphatic group or an aromatic group; $R_{12}$ and $R_{13}$, which may be the same or different, each represents an aliphatic group, an aliphatic oxy group, an aromatic oxy group, an aliphatic thio group, an aromatic thio group, a nitrogen-containing heterocyclic group, an acylamino group, an aliphatic amino group or an aromatic amino group, or $R_{12}$ and $R_{13}$ may combine with each other to form a 5-membered or 6-membered hetero ring; and the aliphatic group or the aromatic group described above may be substituted.

2. The silver halide color photographic material as claimed in claim 1, wherein the pyrazoloazole type coupler is a bis coupler or a polymer coupler containing a coupler moiety represented by general formula (I).

3. The silver halide color photographic material as claimed in claim 2, wherein the polymer coupler is a homopolymer composed of a monomer having a coupler moiety represented by general formula (I) or a copolymer composed of a monomer having a coupler moiety represented by general formula (I) and a non-color forming ethylenic monomer which does not undergo coupling with the oxidation product of an aromatic primary amine developing agent.

4. The silver halide color photographic material as claimed in claim 1, wherein the pyrazoloazole type coupler is represented by the following general formula (I-1), (I-2), (I-3), (I-4), (I-5) or (I-6):

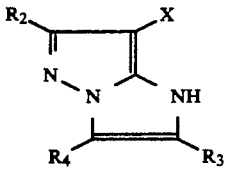

(I-1)

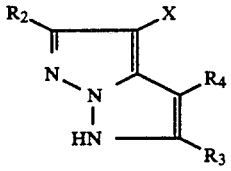

(I-2)

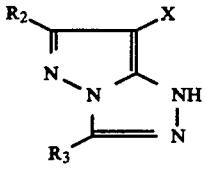

(I-3)

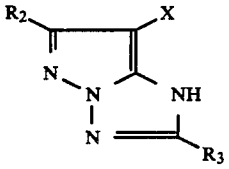

(I-4)

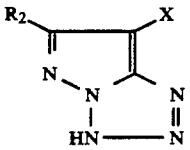

(I-5)

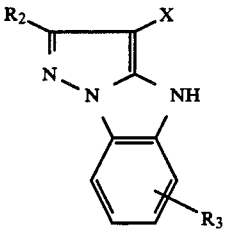

(I-6)

wherein $R_2$, $R_3$ and $R_4$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, an alkoxy group, an aryloxy group, a heterocyclic oxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxy group or a group capable of being released upon coupling which is bonded to the carbon atom at the coupling position through an oxygen atom, a nitrogen atom or a sulfur atom; or $R_2$, $R_3$, $R_4$ or X is a divalent group to form a bis coupler

5. The silver halide color photographic material as claimed in claim 4, wherein the pyrazoloazole type coupler is a polymer coupler in which the coupler moiety derived from the coupler represented by general formula (I-1), (I-2), (I-3), (I-4), (I-5) or (I-6) is present in a vinyl monomer, and $R_2$, $R_3$ or $R_4$ represents a chemical bond or a linking group, through which the coupler moiety is connected to the vinyl group.

6. The silver halide color photographic material as claimed in claim 1, wherein the pyrazoloazole type coupler is represented by general formula (XI):

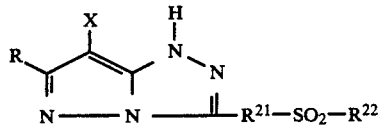

(XI)

wherein R represents a hydrogen atom or a substituent; $R^{21}$ represents an alkylene group; $R^{22}$ represents an alkyl group, a cycloalkyl group or an aryl group; and X represents a hydrogen atom or a group capable of being released upon coupling.

7. The silver halide color photographic material as claimed in claim 4, wherein X is a halogen atom and $R_2$ is connected to the pyrazoloazole ring through a carbon atom.

8. The silver halide color photographic material as claimed in claim 4, wherein X is a halogen atom or a group capable of being released upon coupling which is bonded to the coupling position through an oxygen atom, a nitrogen atom or a sulfur atom and $R_2$ is connected to the pyrazoloazole ring through a hetero atom.

9. The silver halide color photographic material as claimed in claim 4, wherein the pyrazoloazole azole type coupler is a compound represented by general formula (I-1), (I-3) or (I-4).

10. The silver halide color photographic material as claimed in claim 9, wherein the pyrazoloazole type coupler is a compound represented by general formula (I-4).

11. The silver halide color photographic material as claimed in claim 1, wherein the aliphatic group included in $R_{10}$, $R_{11}$, $R_{12}$ or $R_{13}$ has from 1 tO 32 carbon atoms.

12. The silver halide color photographic material as claimed in claim 1, wherein the aromatic group included in $R_{10}$, $R_{11}$, $R_{12}$ or $R_{13}$ has from 6 to 32 Carbon atoms.

13. The silver halide color photographic material as claimed in claim 1, wherein the substituent for the aliphatic group or the aromatic group in formula (II) is selected from the group consisting of an alkyl group, an aromatic group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, aromatic sulfonyl group, an aliphatic thio group, an aromatic thio group, a hydroxy group, a cyano group, a carboxy group, a nitro group, a sulfo group and a halogen atom.

14. The silver halide color photographic material as claimed in claim 1, wherein $R_{12}$ and $R_{13}$ are combined with each other to represent a methylenedioxy group or an ethylenedioxy group.

15. The silver halide color photographic material as claimed in claim 1, wherein $R_{12}$ and $R_{13}$ each represents an aliphatic group or an aliphatic oxy group.

16. The silver halide color photographic material as claimed in claim 1, wherein a silver halide emulsion layer contains the pyrazoloazole type coupler represented by general formula (I) and the compound represented by general formula (II).

17. The silver halide color photographic material as claimed in claim 16, wherein the amount of the compound represented by general formula (II) is in a range from 1 to 600 mol % based on the pyrazoloazole type coupler represented by general formula (I).

18. The silver halide color photographic material as claimed in claim 16, wherein the amount of the pyrazoloazole type coupler represented by general formula (I) is in a range from $2\times10^{-3}$ to $5\times10^{-1}$ mol per mol of silver.

19. The silver halide color photographic material as claimed in claim 16, wherein the silver halide emulsion layer is a green-sensitive silver halide emulsion layer.

20. The silver halide color photographic material as claimed in claim 19, wherein the silver halide color photographic material further comprises at least one blue-sensitive silver halide emulsion layer containing at least one yellow color forming coupler and at least one red-sensitive silver halide emulsion layer containing at least one cyan color forming coupler, said silver halide emulsion layers each containing silver chloride or silver chlorobromide having the silver chloride content of not less than 90 mole %.

* * * * *